US010515650B2

(12) United States Patent
Kato et al.

(10) Patent No.: US 10,515,650 B2
(45) Date of Patent: Dec. 24, 2019

(54) SIGNAL PROCESSING APPARATUS, SIGNAL PROCESSING METHOD, AND SIGNAL PROCESSING PROGRAM

(71) Applicant: NEC CORPORATION, Tokyo (JP)

(72) Inventors: Masanori Kato, Tokyo (JP); Akihiko Sugiyama, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/740,413

(22) PCT Filed: Jun. 2, 2016

(86) PCT No.: PCT/JP2016/066481
§ 371 (c)(1),
(2) Date: Dec. 28, 2017

(87) PCT Pub. No.: WO2017/002525
PCT Pub. Date: Jan. 5, 2017

(65) Prior Publication Data

US 2018/0190311 A1 Jul. 5, 2018

(30) Foreign Application Priority Data

Jun. 30, 2015 (JP) ..... 2015-131978

(51) Int. Cl.
*G10L 21/0264* (2013.01)
*H04R 3/00* (2006.01)
(Continued)

(52) U.S. Cl.
CPC ..... *G10L 21/0264* (2013.01); *G10L 21/0216* (2013.01); *G10L 21/0224* (2013.01);
(Continued)

(58) Field of Classification Search
None
See application file for complete search history.

(56) References Cited

U.S. PATENT DOCUMENTS 8,682,006 B1 * 3/2014 Laroche ..... G10L 21/0208 381/71.1
2009/0232330 A1 * 9/2009 Kim ..... H03G 3/301 381/107

(Continued)

FOREIGN PATENT DOCUMENTS

JP 2011244232 A 12/2011
JP 2012022120 A 2/2012
JP 2013078118 A 4/2013

OTHER PUBLICATIONS

A. Sugiyama, et al., "A Directional Noise Suppressor With a Specified Beamwidth", Proc. of ICASSP 2015, pp. 524 to 528, Apr. 2015 (5 pages).

(Continued)

*Primary Examiner* — Antim G Shah
(74) *Attorney, Agent, or Firm* — Sughrue Mion, PLLC

(57) ABSTRACT

A signal processing apparatus, for processing sounds collected in an environment where a target sound and an interfering sound are mixed in order to estimate a diffuse interfering sound accurately, is provided. The signal processing apparatus includes phase difference calculating means and generating means. The phase difference calculating means calculates a phase difference between the first input signal and the second input signal. The first input signal is generated based on the first input sound which is input in the environment where the target sound and the interfering sound are mixed. The second input signal is generated based on the second input sound which is input in the environment. The generating means generates an esti- (Continued)

mated interfering sound signal, based on the phase difference and the first input signal.

17 Claims, 27 Drawing Sheets

(51) Int. Cl.
*G10L 21/0272* (2013.01)
*G10L 21/0224* (2013.01)
*G10L 21/0216* (2013.01)
*G10L 21/0208* (2013.01)

(52) U.S. Cl.
CPC ..... *G10L 21/0272* (2013.01); *H04R 3/00* (2013.01); *G10L 21/0208* (2013.01); *G10L 2021/02161* (2013.01); *G10L 2021/02166* (2013.01)

(56) References Cited

U.S. PATENT DOCUMENTS

2010/0208902 A1* 8/2010 Yoshizawa ..... G10L 21/0208 381/56
2011/0286604 A1* 11/2011 Matsuo ..... H04R 3/005 381/71.1

OTHER PUBLICATIONS

A. Sugiyama, et al., "A Dual-Microphone Noise Suppressor with an Adjustable Constant Beamwidth", Proc. of 29th SIP Symposium, pp. 444 to 449, Nov. 2014 (6 pages).
A. Sugiyama, et al., "Impact-noise suppression with phase-based detection", Proc. of 21st European Signal Processing Conference, pp. 1 to 5, Sep. 2013 (5 pages).
C. H. Knapp, et al. "The Generalized Correlation Method for Estimation of Time Delay", IEEE Trans. on Acoustics, Speech, and Signal Processing, vol. ASSP-24, No. 4, pp. 320 to 327, Aug. 1976 (8 pages).
M. Omologo, et al., "Use of the Crosspower-spectrum Phase in Acoustic Event Location", IEEE Trans. on Speech and Audio Processing, vol. SAP-5, No. 3, pp. 288 to 292, May 1997 (5 pages).
R. Schmidt, "Multiple emitter location and signal parameter estimation", IEEE Trans. on Antennas Propag. vol. AP-34, No. 3, pp. 276 to 280, Mar. 1982 (5 pages).
R. Kumaresan, et al., "Estimating the Angles of Arrival of Multiple Plane Waves", IEEE Trans. on Aerospace and Electronic Systems, vol. AES-19, No. 1, pp. 134 to 139, Jan. 1983 (6 pages).
M. J. Ross, et al., "Average magnitude difference function pitch extractor", IEEE Trans. on Acoustics, Speech and Signal Processing, vol. ASSP-22, No. 5, pp. 353 to 362, 1974 (10 pages).
A. M. Noll, "Short-Time Spectrum and 'Cepstrum' Techniques for Vocal-Pitch Detection", The Journal of Acoustical Society of America, vol. 36, No. 2, pp. 269 to 302, 1964 (8 pages).
A. M. Noll, "Cepstrum Pitch Determination", The Journal of Acoustical Society of America, vol. 41, No. 2, pp. 293 to 309, 1967 (18 pages).
Masakiyo Fujimoto, "The Fundamentals and Recent Progress of Voice Activity Detection", The Institute of Electronics, Information and Communication Engineers, IEICE Technical Report SP2010-23, pp. 7 to 12, Jun. 2010 (6 pages).
B. Rafaely, et al., "Spherical Microphone Array Beam Steering Using Wigner-D Weighting", IEEE Signal Processing Letters, vol. 15, pp. 417 to 420, Dec. 2008 (4 pages).
W. Kellermann, "A Self-Steering Digital Microphone Array", Proc. of ICASSP-91, vol. 5, pp. 3581 to 3584, Apr. 1991 (4 pages).
International Search Report dated Aug. 16, 2016 in PCT/JP2016/066481.

* cited by examiner

SIGNAL PROCESSING APPARATUS, SIGNAL PROCESSING METHOD, AND SIGNAL PROCESSING PROGRAM

CROSS REFERENCE TO RELATED APPLICATIONS

This application is a National Stage of International Application No. PCT/JP2016/066481 filed Jun. 2, 2016, claiming priority based on Japanese Patent Application No. 2015-131978 filed Jun. 30, 2015, the contents of all of which are incorporated herein by reference in their entirety.

TECHNICAL FIELD

The present invention relates to a signal processing apparatus, a signal processing method, and a signal processing program.

BACKGROUND ART

In the above technical field, NPL 1 and NPL 2 disclose techniques of generating an enhanced signal by estimating an interfering sound signal component from a summed signal obtained by summing up mixed signal output from a plurality of sensors, and multiplying a gain determined in accordance with a power of the interfering sound signal component by the summed signal.

CITATION LIST

Non Patent Literature

NPL 1: A. Sugiyama and R. Miyahara, "A Directional Noise Suppressor with a Specified Beamwidth", Proc. of ICASSP 2015, pp. 524 to 528, April 2015

NPL 2: A. Sugiyama and R. Miyahara, "A Dual-Microphone Noise Suppressor with an Adjustable Constant Beamwidth", Proc. of 29th SIP SYMPOSIUM, pp. 444 to 449, November 2014

NPL3: A. Sugiyama, R. Miyahara and K. Park, "Impact-noise suppression with phase-based detection", Proc. of 21st European Signal Processing Conference, pp. 1 to 5, September 2013

NPL4: C. H. Knapp and G. C. Carter, "The Generalized Correlation Method for Estimation of Time Delay", IEEE Trans. on Acoustics, Speech, and Signal Processing, vol. ASSP-24, no. 4, pp. 320 to 327, August 1976

NPL5: M. Omologo and P. Svaizer, "Use of the Crosspower-spectrum Phase in Acoustic Event Location", IEEE Trans. on Speech and Audio Processing, vol. SAP-5, no. 3, pp. 288 to 292, May 1997

NPL6: R. Schmidt, "Multiple emitter location and signal parameter estimation", IEEE Trans. on Antennas Propag. vol. AP-34, no. 3, pp. 276 to 280, March 1982

NPL7: R. Kumaresan and D. W. Tufts, "Estimating the Angles of Arrival of Multiple Plane Waves", IEEE Trans. on Aerospace and Electronic Systems, vol. AES-19, no. 1, pp. 134 to 139, January 1983

NPL8: M. J. Ross, H. L. Shaffer, A. Cohen, R. Freudberg and H. J. Manley, "Average magnitude difference function pitch extractor", IEEE Trans. on Acoustics, Speech and Signal Processing, vol. ASSP-22, no. 5, pp. 353 to 362, 1974

NPL9: A. M. Noll, "Short Time Spectrum and 'Cepstrum' Techniques for Vocal Pitch Detection", The Journal of Acoustical Society of America, vol. 36, no. 2, pp. 269 to 302, 1964

NPL 10: A. M. Noll, "Cepstrum Pitch Determination", The Journal of Acoustical Society of America, vol. 41, no. 2, pp. 293 to 309, 1967

NPL 11: Masakiyo Fujimoto, "The Fundamentals and Recent Progress of Voice Activity Detection", The Institute of Electronics, Information and Communication Engineers, IEICE Technical Report SP2010-23, pp. 7 to 12, June 2010

NPL 12: B. Rafaely and M. Kleider, "Spherical Microphone Array Beam Steering Using Wigner-D Weighting", IEEE Signal Processing Letters, vol. 15, pp. 417 to 420, December 2008

NPL 13: W. Kellermann, "A Self-Steering Digital Microphone Array", Proc. of ICASSP-91, vol. 5, pp. 3581 to 3584, April 1991

SUMMARY OF INVENTION

Technical Problem

In the techniques described in NPL 1 and NPL 2, an interfering sound arriving from various directions, for example, environmental noise such as car noise and street noise, or diffuse noise such as ambient noise and wind noise, cannot be estimated accurately.

The present invention enables to provide a technique of solving the above-described problem.

Solution to Problem

One aspect of the present invention provides a signal processing apparatus including:

a phase difference calculating means for calculating a phase difference between a first input signal obtained in an environment where a target sound and an interfering sound are mixed, and a second input signal obtained in the environment; and a generating means for generating an estimated interfering sound signal, based on the phase difference and the first input signal.

Another aspect of the present invention provides a signal processing method including:

a step for calculating a phase difference between a first input signal obtained in an environment where a target sound and an interfering sound are mixed, and a second input signal obtained in the environment; and a step for generating an estimated interfering sound signal, based on the phase difference and the first input signal.

Still other aspect of the present invention provides a signal processing program causing a computer to execute:

a step for calculating a phase difference between a first input signal obtained in an environment where a target sound and an interfering sound are mixed, and a second input signal obtained in the environment; and a step for generating an estimated interfering sound signal, based on the phase difference and the first input signal.

Advantageous Effects of Invention

According to the present invention, it is possible to estimate a diffuse interfering sound accurately.

DESCRIPTION OF EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise. In the following explanation, "speech" indicates contents of auditory sensation or a sound wave causing the auditory sensation, which is generated by some sound, a human voice, animal sound, or vibration propagating as air vibration or the like, and is not limited to human voice. In addition, "speech signal" indicates a direct electrical change, which occurs with speech or other acoustic sound, to transmit speech or other acoustic sound and is not limited to speech.

First Embodiment

Figure 1:
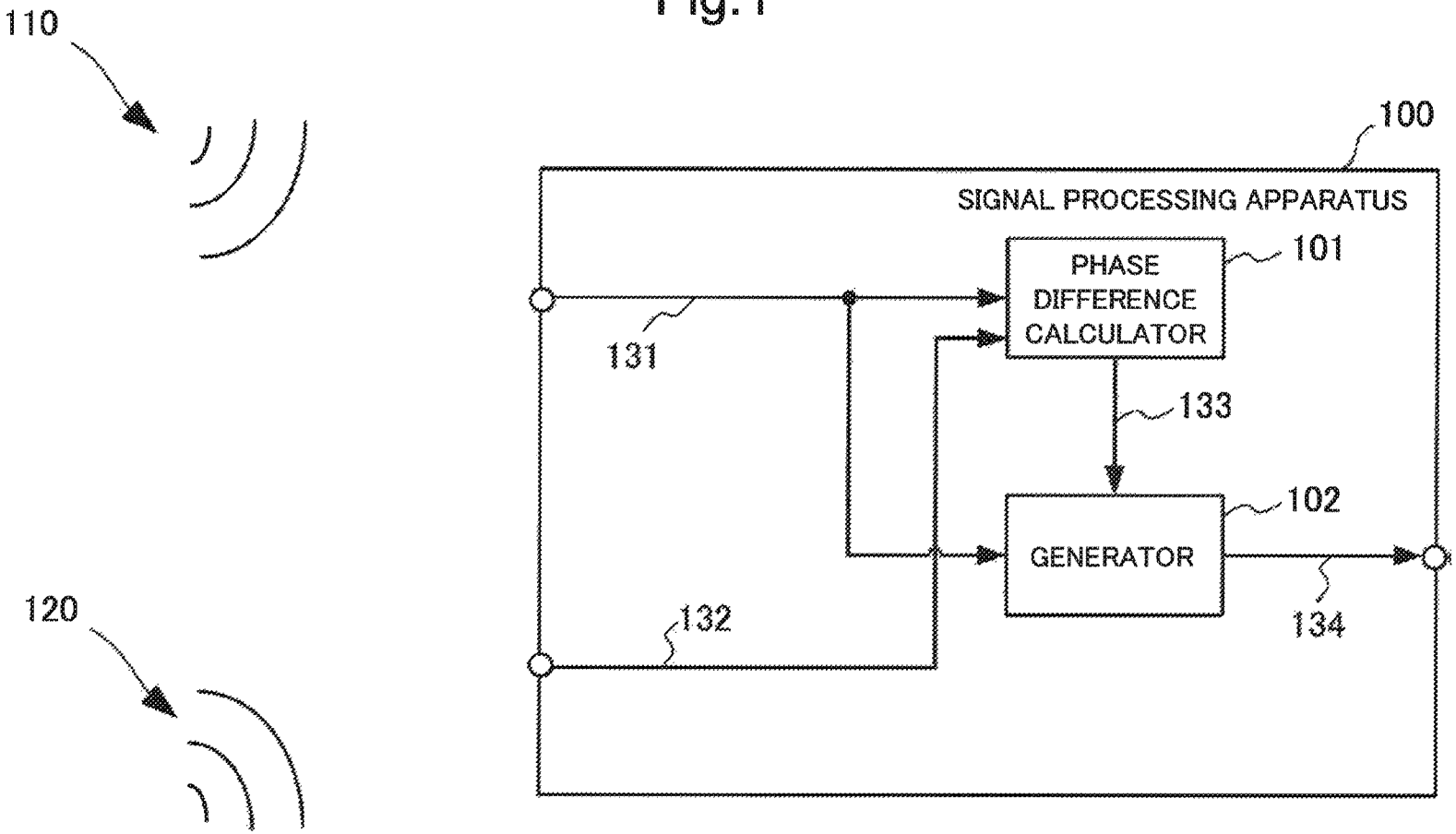
FIG. 1 is a block diagram showing an arrangement of the signal processing apparatus according to the first embodiment of the present invention.

A signal processing apparatus 100 according to the first embodiment of the present invention will be described with reference to FIG. 1. As shown in FIG. 1, the signal processing apparatus 100 includes a phase difference calculator 101 and a generator 102. The phase difference calculator 101 calculates a phase difference 133 between the first input signal 131 and the second input signal 132 as an output. The first input signal 131 is generated based on the first input sound which is input in an environment where a target sound 110 and an interfering sound 120 are mixed. The second input signal 132 is generated based on the second input sound which is input in the environment. The generator 102 generates an estimated interfering sound signal 134 based on the phase difference 133 and the first input signal 131.

According to this embodiment, it is possible to estimate an interfering sound arriving from various directions. Consequently, an interfering sound included in the first input signal can be suppressed using the estimated interfering sound signal, and thereby the target sound can be enhanced. Therefore, quality of the enhanced signal is improved as compared with the prior art.

Second Embodiment

Figure 2:
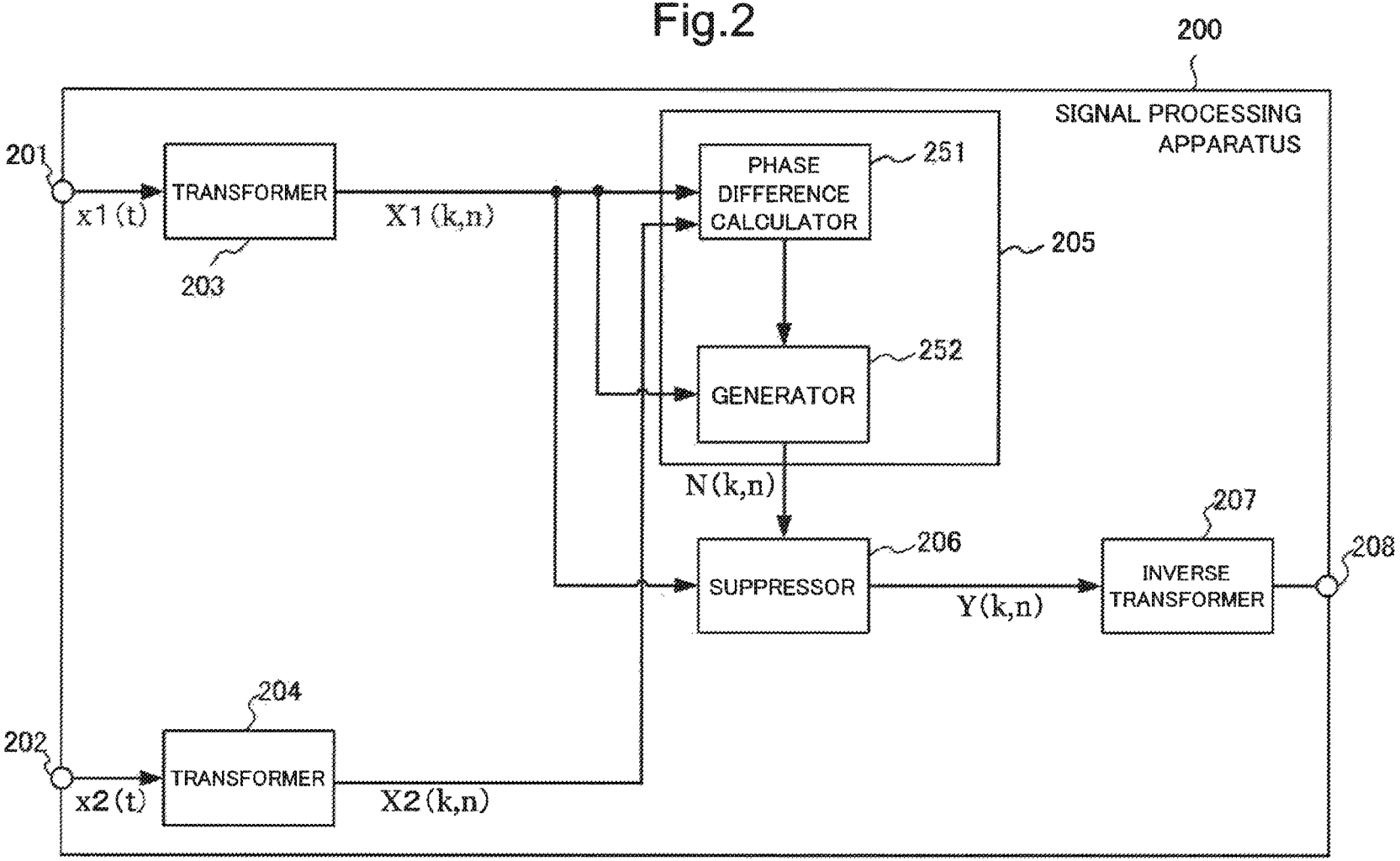
FIG. 2 is a block diagram showing an arrangement of the signal processing apparatus according to the second embodiment of the present invention.

A signal processing apparatus according to the second embodiment of the present invention will be described with reference to FIGS. 2 to 7B. FIG. 2 is a block diagram showing an arrangement of the signal processing apparatus according to this embodiment. A signal processing apparatus 200 according to this embodiment may function as a part of an apparatus such as a digital camera, a laptop computer, or a cellular phone. However, the present invention is not limited to them, but may be applied to various signal processing apparatuses in which an interfering sound component is to be removed from an input signal acquired in an environment where a target sound and an interfering sound are mixed.

This embodiment is described as a technique for first estimating the second signal component (interfering sound component) with a null beamformer using a phase difference, and then enhancing the first signal component (target sound component). However, the present invention is not limited to this pattern of estimation followed by enhancement.

As shown in FIG. 2, the signal processing apparatus 200 includes sensors 201 and 202, transformers 203 and 204, an estimator 205, a suppressor 206, an inverse transformer 207, and an output terminal 208.

A mixed signal generated by the sensor 201 is supplied to the transformer 203 as a series of sample values x1(*t*). The transformer 203 divides the mixed signal generated by the sensor 201 into frames each including a plurality of samples, and transforms the data in each of the frames into a plurality of frequency components by applying a transform, such as Fourier transform.

A mixed signal generated by the sensor 202 is supplied to the transformer 204 as a series of sample values x2(*t*). The transformer 204 divides the mixed signal generated by the sensor 202 into frames each including a plurality of samples, transforms the data in each of the frames into a plurality of frequency components by applying a transform, such as Fourier transform. Note that the frequency components obtained by transforming the mixed signal is referred to as a mixed signal spectrum. Input signals from the sensors 201 and 202 may be speech signals or signals other than speech signals. For example, the sensors 201 and 202 may output signals of sound such as driving sound, engine sound, screw sound, propeller sound, motor sound, siren sound, or explosion sound generated by a machine, such as a car, a ship, or a flying object. The sensors 201 and 202 may also output signals of various sound such as footstep, scream, crying, shouting of human or animal, music, or instrumental sound.

The mixed signal spectra are independently processed frequency by frequency. The description will be continued here by paying attention to a frequency k in a frame n. A mixed signal spectrum X1(*k, n*) from the transformer 203 is supplied to the estimator 205 and the suppressor 206. The transformer 203 generates the mixed signal spectrum X1(*k, n*) as an input signal based on an input sound which is input in the environment where the target sound and interfering sound are mixed.

A mixed signal spectrum X2(*k, n*) from the transformer 204 is supplied to the estimator 205. The transformer 204 generates the mixed signal spectrum X2(*k, n*) as an input signal based on an input sound which is input in the environment where the target sound and interfering sound are mixed.

The estimator 205 estimates the second signal component included in the mixed signal spectrum X1(*k, n*) supplied from the transformer 203 to generate an estimated second signal component N(k, n).

The suppressor 206 suppresses the second signal component included in the mixed signal spectrum X1(*k, n*) supplied from the transformer 203 using the estimated second signal component N(k, n), and transmits an enhanced signal spectrum Y(k, n) which is a result of suppression to the inverse transformer 207. The inverse transformer 207 applies inverse transform on the enhanced signal spectrum Y(k, n) supplied from the suppressor 206 to generate an enhanced signal, and supplies the enhanced signal to the output terminal 208. Note that the estimator 205 may estimate the second signal component included in the mixed signal spectrum X2(*k, n*), instead of the second signal component included in the mixed signal spectrum X1(*k, n*).

<Arrangement of Transformer>

Figure 3:
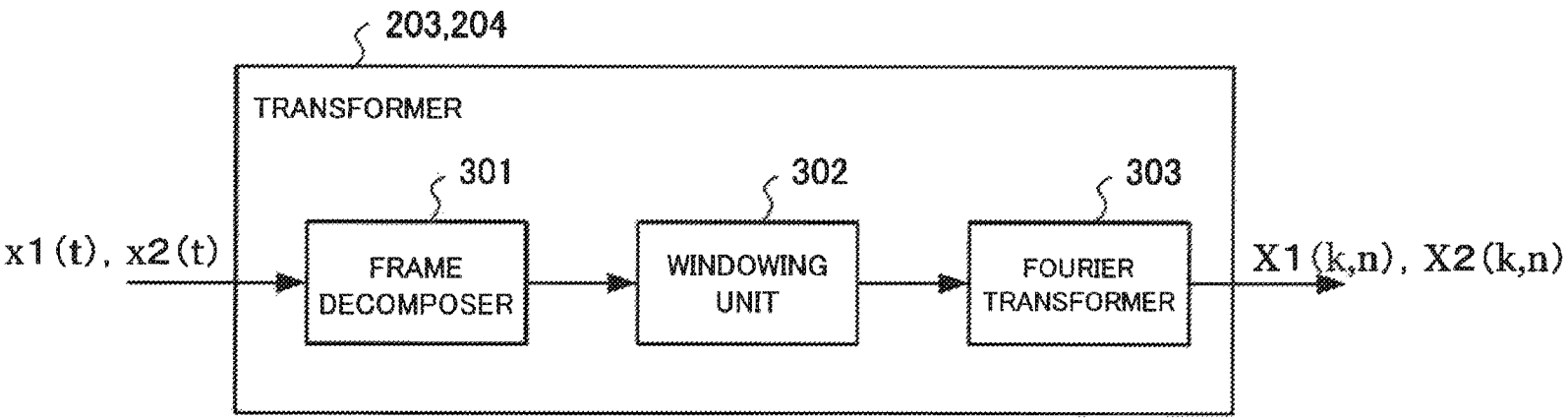
FIG. 3 is a block diagram showing an arrangement of the transformer in the signal processing apparatus according to the second embodiment of the present invention.

FIG. 3 is a block diagram showing an arrangement of each of the transformers 203 and 204. As shown in FIG. 3, the transformers 203 and 204 each include a frame decomposer 301, a windowing unit 302, and a Fourier transformer 303.

Mixed signals x1(*t*) or x2(*t*) is supplied to the frame divider 301 and divided into frames with every of K/2 samples, where K is an even number. The mixed signals x1(*t*) or x2(*t*) divided into frames is supplied to the windowing unit 302 and multiplied by a window function w(t). The signal obtained by windowing the mixed signal x1(*t, n*) (t=0, 1, . . . , K−1) in frame n by w(t) is given by the following equation.

$$\overline{x1}(t,n)=w(t)x1(t,n). \quad \text{[Equation 1]}$$

Two successive frames may partially be overlapped and windowed. Assuming that the overlap length is 50% of the frame length, for t=0, 1, . . . , K/2−1, the windowing unit 302 outputs the left-hand sides of the following equation.

$$\overline{x}1(t,n)=\begin{cases} w(t)x1(t,n-1), & 0 \leqq t < K/2 \\ w(t)x1(t-K/2,n), & K/2 \leqq t < K \end{cases}. \quad \text{[Equation 2]}$$

A symmetrical window function is used for a real signal. The window function is designed in such a way that the input signal and the output signal match with each other except a calculation error when the output of the transformers 203 or 204 is directly supplied to the inverse transformer 207. This means that $w(t)^2+w(t+K/2)^2=1$.

The description will be continued below assuming 50% overlap for the two successive frames. As w(t) (t=0, 1, . . . , K−1), the windowing unit may use, for example, Hanning window given by the following equation.

$$w(t)=0.5+0.5\cos\left(\frac{\pi(t-K/2)}{K/2}\right). \quad \text{[Equation 3]}$$

Various window functions such as Hamming window and triangular window are also known. The windowed output is supplied to the Fourier transformer 303 and transformed into mixed signal spectrum X1(*k, n*) or X2(*k, n*).

<Arrangement of Inverse Transformer>

Figure 4:
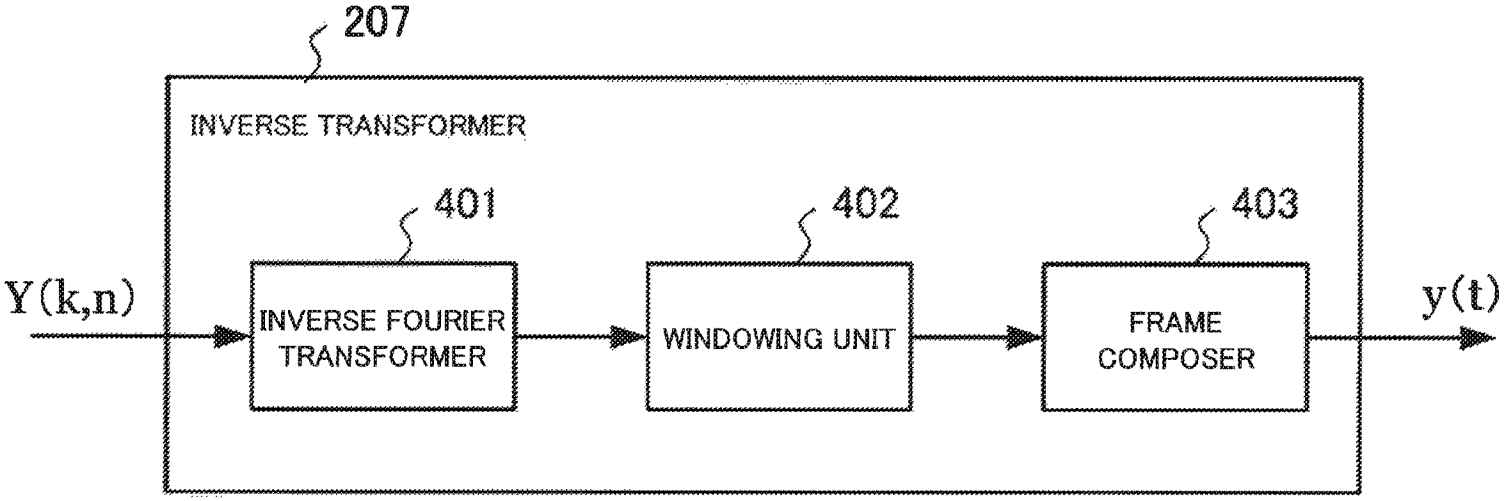
FIG. 4 is a block diagram showing an arrangement of the inverse transformer in the signal processing apparatus according to the second embodiment of the present invention.

FIG. 4 is a block diagram showing an arrangement of the inverse transformer 207. As shown in FIG. 4, the inverse transformer 207 includes an inverse Fourier transformer 401, a windowing unit 402, and a frame composer 403.

The inverse Fourier transformer 401 applies inverse Fourier transform to the enhanced signal spectrum Y(k, n) supplied from the suppressor 206, and supplies K time-domain sample values y(t, n) (t=0, 1, . . . , K−1) with the windowing unit 402. The windowing unit 402 multiplies the time domain samples by the window function w(t). A signal obtained by windowing the signal y(t, n) (t=0, 1, . . . , K−1) obtained by the inverse Fourier transform is given by the left-hand side of the following equation.

$$\overline{y}(t,n)=w(t)y(t,n). \quad \text{[Equation 4]}$$

The frame composer 403 extracts two adjacent frames of the outputs from the windowing unit 402, where each frame consists of K/2 samples, overlaps them, and generates an output signal (y-hat(t, n) in the left-hand side of the following equation) for t=0, 1, . . . , K/2−1. The obtained output signal y-hat(t, n) is transmitted to the output terminal 208 as an enhanced signal from the frame composer 403.

$$\hat{y}(t,n)=y(t+K/2,n-1)+\bar{y}(t,n). \quad \text{[Equation 5]}$$

Note that the transform in the transformer 203 and the inverse transformer 207 in FIGS. 3 and 4 has been described as Fourier transform, however, any other transform such as Hadamard transform, Haar transform, or Wavelet transform may be used instead. Haar transform does not need multiplication and can reduce the LSI footprint. Wavelet transform provides different time resolutions at different frequencies and is therefore expected to improve suppression of the second signal component.

The estimator 205 may estimate the second signal component after a plurality of frequency components obtained by the transformer 203 are integrated. The number of frequency components after integration is smaller than the number of frequency components before integration. More specifically, an estimated second signal component N(k, n) is obtained for the integrated frequency component obtained by integrating the frequency components. A new estimated second signal component which is smaller in number is commonly used for multiple frequency components corresponding to the same integrated frequency component. When the estimation of the second signal component is executed after integrating a plurality of frequency components, the number of frequency components to which the estimation is applied decreases, and the total calculation amount can be decreased.

<Arrangement of Suppressor>

Figure 5:
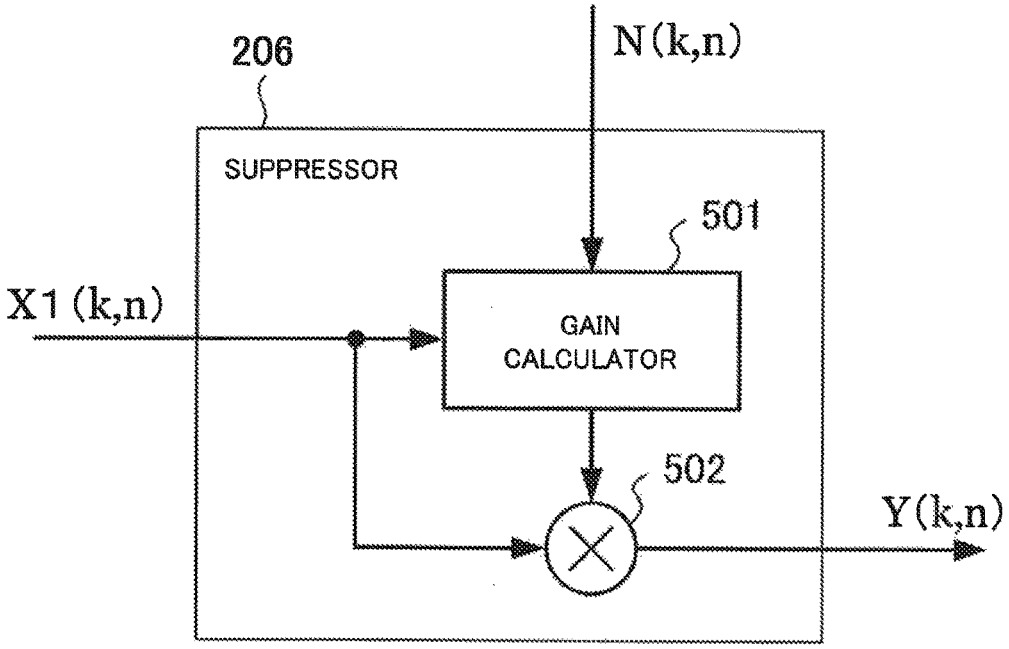
FIG. 5 is a block diagram showing an arrangement of the suppressor in the signal processing apparatus according to the second embodiment of the present invention.

FIG. 5 is a block diagram showing an arrangement of the suppressor 206. As shown in FIG. 5, the suppressor 206 includes a gain calculator 501 and a multiplier 502.

The gain calculator 501 obtains a gain G2(*k, n*) for suppressing the second signal component. Various methods can be used as a gain calculation method in the gain calculator 501. For example, a gain may be obtained by a Wiener filter which outputs an optimum estimated value for minimizing a mean-squared error between the first signal component and the multiplication result with the gain G2(*k, n*). Alternatively, a gain may be obtained by other known methods such as GSS (Generalized Spectral Subtraction), MMSE STSA (Minimum Mean-Square Error Short-Time Spectral Amplitude), and MMSE LSA (Minimum Mean-Square Error Log Spectral Amplitude).

The multiplier 502 obtains an enhanced signal spectrum Y(k, n) by multiplying the gain G2(*k, n*) obtained in the gain calculator 501 by the mixed signal spectrum X1(*k, n*). The enhanced signal spectrum Y(k, n) is transmitted to the inverse transformer 207.

<Arrangement of Estimator>

Figure 6A:
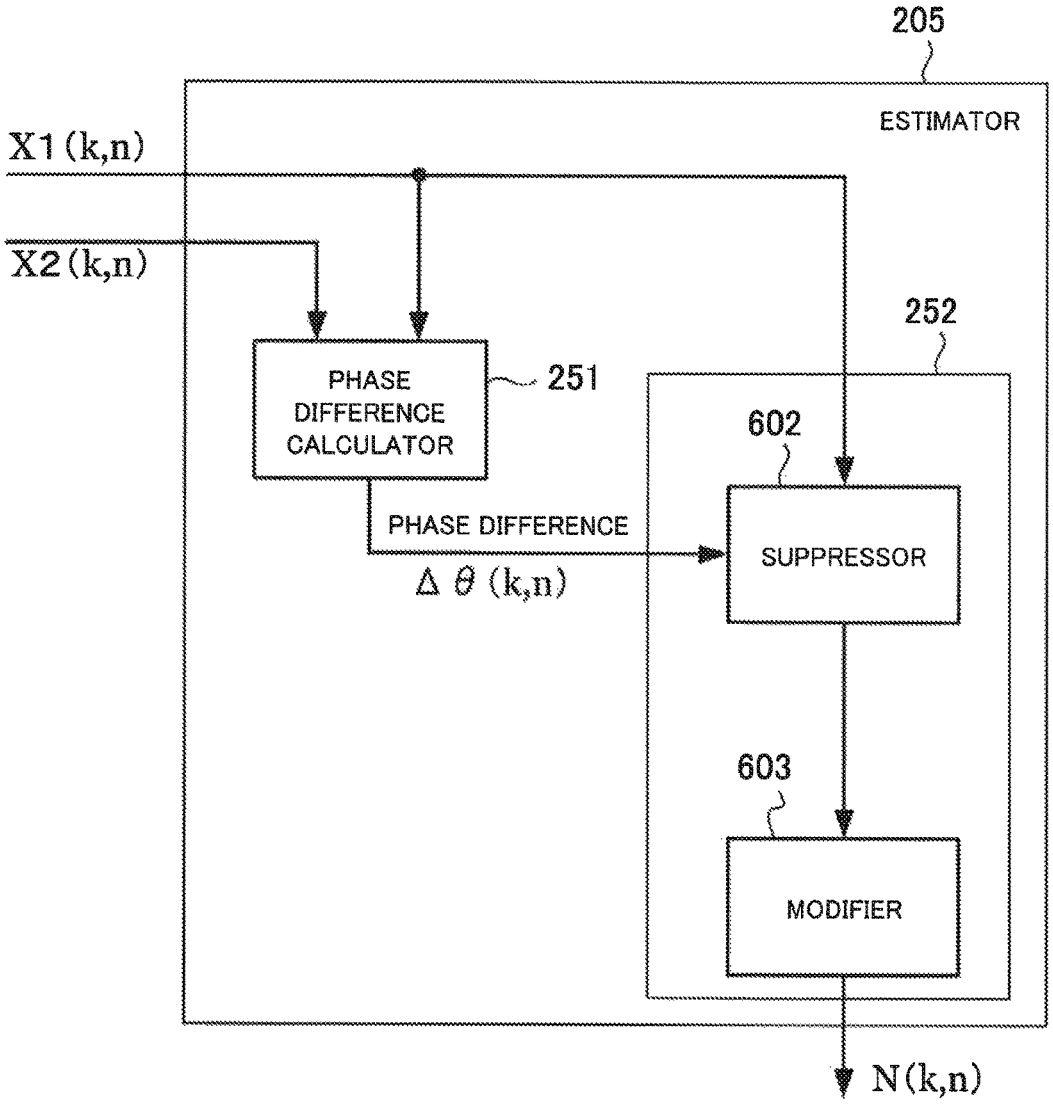
FIG. 6A is a block diagram showing an arrangement of the estimator in the signal processing apparatus according to the second embodiment of the present invention.

FIG. 6A is a block diagram showing an arrangement of the estimator 205. As shown in FIG. 6A, the estimator 205 includes a phase difference calculator 251 and a generator 252. The generator 252 includes a suppressor 602 and a modifier 603.

Figure 6B:
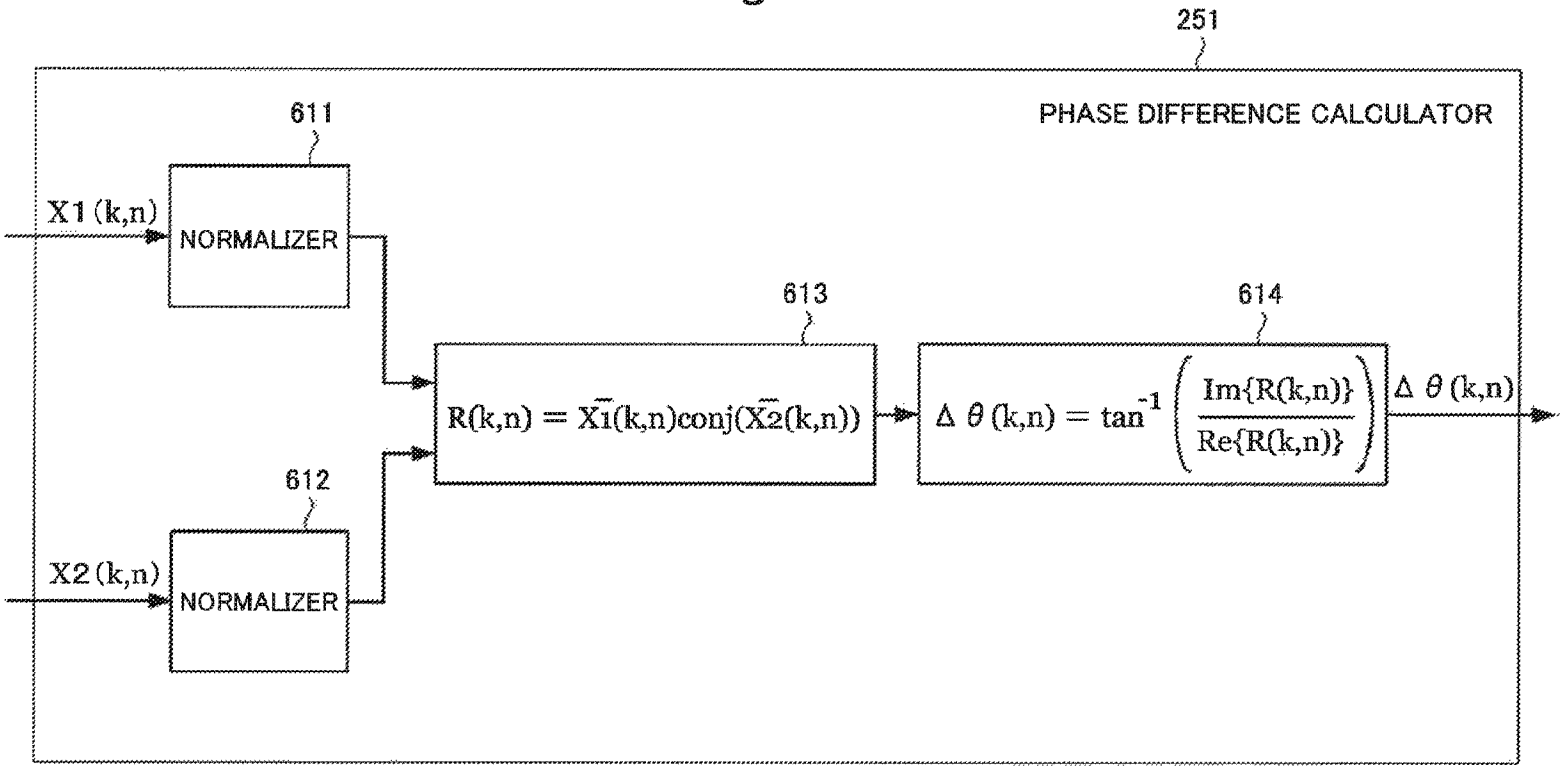
FIG. 6B is a block diagram showing an arrangement of the phase difference calculator in the signal processing apparatus according to the second embodiment of the present invention.

As shown in FIG. 6B, the phase difference calculator 251 includes normalizers 611, 612 and calculators 613, 614.

The phase difference calculator 251 calculates a phase difference between the phase of the mixed signal spectrum X1(*k, n*) supplied from the transformer 203 and the phase of the mixed signal spectrum X2(*k, n*) supplied from the transformer 204. A phase O(k, n) of a mixed signal spectrum X(k, n) is defined by the following equation.

$$\theta(k,n)=\tan^{-1}\left(\frac{\mathrm{Im}\{X(k,n)\}}{\mathrm{Re}\{X(k,n)\}}\right), \quad \text{[Equation 6]}$$

where Re{X(k, n)} and Im{X(k, n)} represent the real part and the imaginary part of the mixed signal spectrum X(k, n), respectively. In order to obtain the phase difference in a simplest way, the phase of the mixed signal spectrum X1(*k, n*) and the phase of the mixed signal spectrum X2(*k, n*) are separately obtained by the above equation, and then a difference between the phases is calculated. However, it is known that it is difficult for this method to calculate the phase difference accurately. Accordingly, in this embodiment, the phase difference is calculated by the method described in NPL3.

Specifically, when the phases of the mixed signal spectra X1(*k, n*) and X2(*k, n*) of the n-th frame are represented by θ1(*k, n*) and θ2(*k, n*), respectively, a phase difference Δθ(k, n)=θ1(*k, n*)−θ2(*k, n*) is calculated by the following procedure. First, each of the mixed signal spectra X1(*k, n*) and the X2(*k, n*) is normalized by the corresponding amplitude. The normalized spectra, X1(*k, n*) bar and an X2(*k, n*) bar, are calculated by the following equations.

$$\overline{X}1(k,n)=\frac{X1(k,n)}{|X1(k,n)|} \quad \text{[Equation 7]}$$

$$\overline{X}2(k,n)=\frac{X2(k,n)}{|X2(k,n)|},$$

where |X(k, n)| represents the absolute value of X(k, n). Next, a product of the X1(*k, n*) bar and a complex conjugate of the X2(*k, n*) bar is calculated. When the product is represented by R(k, n), R(k, n) is calculated by the following equation.

$$R(k,n)=\overline{X1}(k,n)\mathrm{conj}(\overline{X2}(k,n)), \quad \text{[Equation 8]}$$

where conj(X(k, n)) represents the complex conjugate of X(k, n). The phase difference Δθ(k, n) is obtained by the following equation.

$$\Delta\theta(k,n)=\tan^{-1}\left(\frac{\mathrm{Im}\{R(k,n)\}}{\mathrm{Re}\{R(k,n)\}}\right). \quad \text{[Equation 9]}$$

Alternatively, as described in NPL 1 and NPL 2, the phase difference may be obtained based on a direction of arrival (DOA) of the target sound. In this case, first, the DOA of the target sound is estimated, and the phase difference is calculated based on the estimated value. When the estimated DOA is represented by Φ(n), the phase difference Δθ(k, n) is obtained by the following equation.

$$\Delta\theta(k,n)=\frac{2\pi kd\sin(\Phi(n))}{c}, \quad \text{[Equation 10]}$$

where d represents the distance between the sensor 201 and the sensor 202, c represents the sound velocity, and π represents a circular constant. As a method for estimating the DOA Φ(n), various methods are known. For example, NPL4 to NPL7 disclose methods using a phase difference between input signals generated based on sounds arriving at a plurality of sensors such as a cross-correlation method, a cross-spectral power analysis method, GCC-PHAT, or the like, a subspace method represented by the MUSIC method, and the like.

Figure 6C:
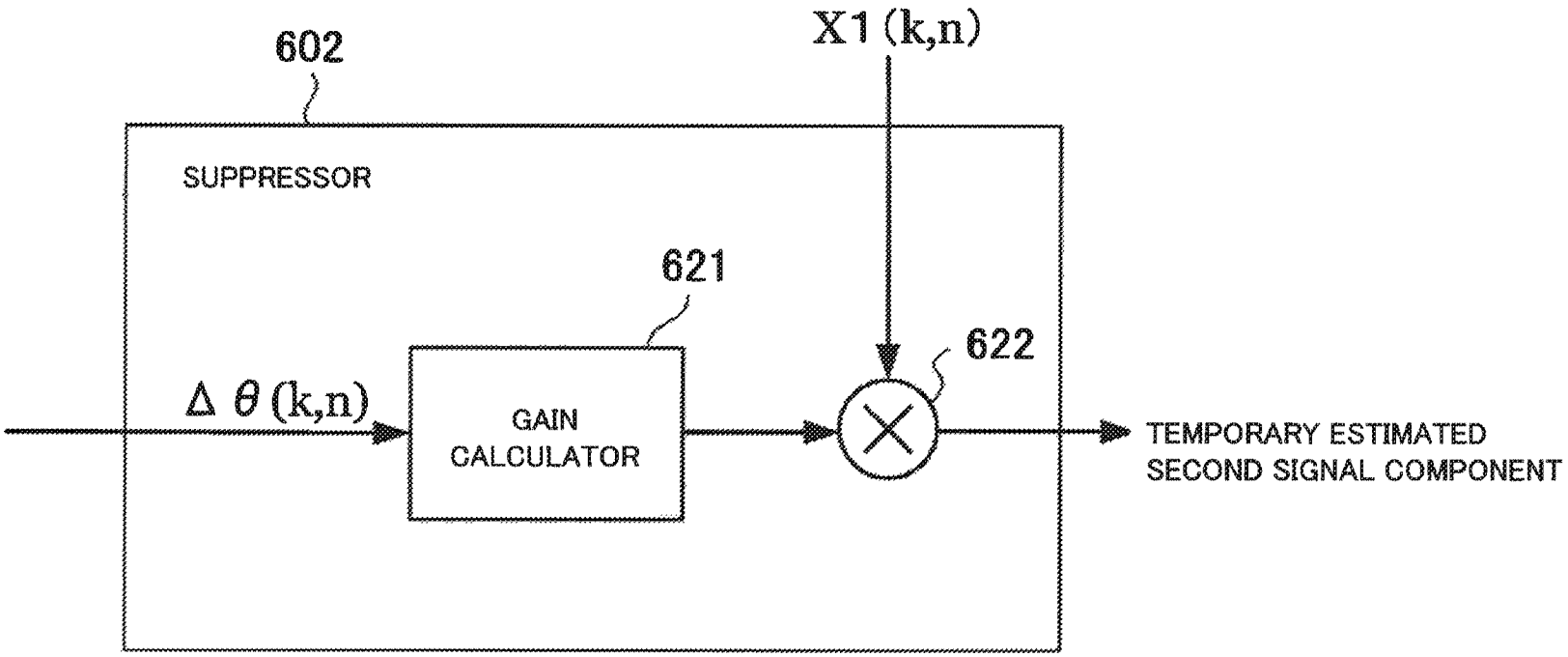
FIG. 6C is a block diagram showing another arrangement of the suppressor in the signal processing apparatus according to the second embodiment of the present invention.

As shown in FIG. 6C, the suppressor 602 includes a gain calculator 621 and a multiplier 622.

The suppressor 602 generates a temporary estimated second signal component by suppressing the first signal component included in the mixed signal spectrum X1(*k, n*) supplied from the transformer 203, based on the phase difference supplied from the phase difference calculator 251.

Figure 7A:
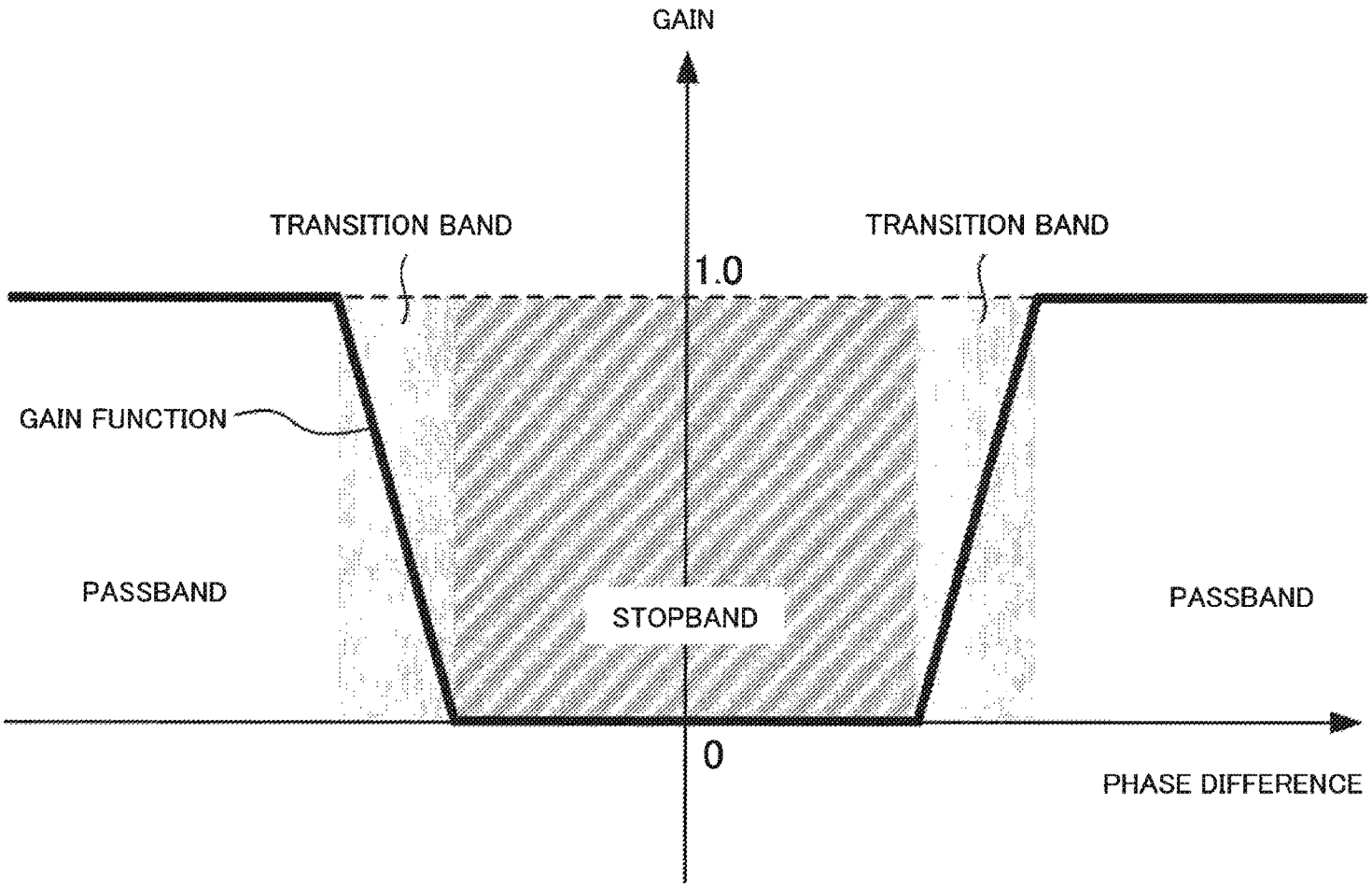
FIG. 7A is a graph showing an example of the gain function in the signal processing apparatus according to the second embodiment of the present invention.

The suppressor 602 first calculates a gain G(k, n) using the phase difference Δθ(k, n). Next, the suppressor 602 calculates a product of the mixed signal spectrum X1(*k, n*) and the gain G(k, n) as the temporary estimated second signal component. The suppressor 602 obtains the gain G(k, n) using a predetermined function (gain function) of a relationship between the phase difference and the gain. FIG. 7A shows an example of the gain function.

In FIG. 7A, the abscissa represents the phase difference Δθ(k, n), and the ordinate represents the gain. In this example, the gain is set to fall within a range of 1 to 0. When the gain is 1, the suppressor 602 allows the input signal to pass through without attenuation. When the gain is 0, the suppressor 602 attenuates the input signal and passes nothing. The range of phase differences having a gain of 1 is called a passband. The range of continuous phase differences having a gain of 0 is called a stopband. Between a passband and a stopband, there may be a transition band in which the gain slowly changes from 1 to 0 or 0 to 1.

In FIG. 7A, the passband is colored in white, the transition band is shaded, and the stopband is hatched for readability. As is apparent from FIG. 7A, in this example, there are a stopband around the phase difference Δθ(k, n)=0 and passbands away therefrom, which are connected by transition bands. In this case, the first signal component with a phase difference Δθ(k, n) close to 0 is attenuated, and that with a phase difference Δθ(k, n) away from 0 passes through without attenuation. Between those bands, there are transition bands of the phase difference Δθ(k, n) in which the first signal component is partially attenuated. The passband and stopband may be directly continued without any transition band. The phase difference Δθ(k, n)=0 represents that a sound arrives from a direction perpendicular to the straight line connecting the sensor 201 and the sensor 202. Therefore, it is understood that the characteristic of the suppressor 602 of FIG. 7A sufficiently attenuates an input signal corresponding to a sound arriving from the front direction and passes through an input signal corresponding to a sound arriving from other directions.

Alternatively, functions described in NPL 1 and NPL 2 may be used as the gain function. For example, NPL 1 and NPL 2 disclose an example in which the gain function changes more gradually than that in FIG. 7A around a change point from the passband to the transition band, and around a change point from the transition band to the stopband. In addition, an example in which the gain function is asymmetrical around the phase-difference axis, i.e., left-right asymmetry in the example of FIG. 7A is also disclosed.

The modifier 603 modifies the temporary estimated second signal component supplied from the suppressor 602 to generate an estimated second signal component N(k, n). A most basic modification method is smoothing of the temporary estimated second signal component. The temporary estimated second signal component is smoothed along time or frequency, and the smoothed temporary estimated second signal component is used as the estimated second signal component N(k, n). For smoothing, leaky integration or moving average can be used. For example, when the temporary estimated second signal component is represented by N(k, n) hat, the estimated second signal component N(k, n) is calculated by the following equation for smoothing along frequency with moving average.

$$N(k,n)=\frac{1}{M+1}\sum_{m=0}^{M}\hat{N}(k+m,n), \qquad \text{[Equation 11]}$$

where M is an integer equal to or greater than 1. Alternatively, the estimated second signal component N(k, n) is calculated by the following equation for smoothing along time with leaky integration.

$$N(k,n)=(1-a)N(k,n-1)+a\hat{N}(k,n), \qquad \text{[Equation 12]}$$

where a is a real number between 0 and 1. The smoothing method is not limited to leaky integration and moving average. A high-order polynomial, a non-linear function, or the like may also be used for smoothing.

Figure 7B:
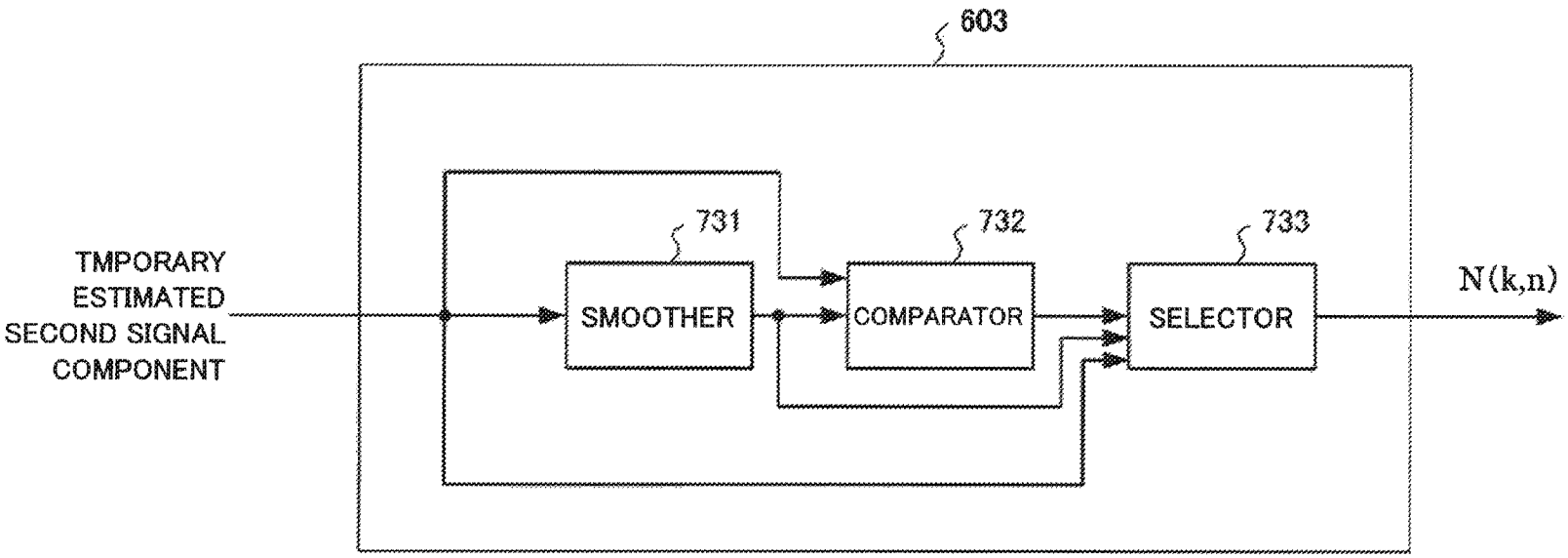
FIG. 7B is a block diagram showing an arrangement of the modifier in the signal processing apparatus according to the second embodiment of the present invention.

It is also effective to use a modification method in which the temporary estimated second signal is replaced with a smoothed value only when a difference between the temporary estimated second signal components before and after smoothing is large. When the difference between the temporary estimated second signal components before and after smoothing is small, signals with a small phase difference do not exist. In other words, only the second signal component exists. In such a case, smoothing reduces the accuracy of estimating the second signal component. Accordingly, by limiting the replacement of the temporary estimated second signal with the smoothed value to the case where the difference between the temporary estimated second signal components before and after smoothing is large, it is possible to improve the accuracy of estimating the second signal component, as compared with the case where the replacement with the smoothed value is performed for every temporary estimated second signal component. In this case, as shown in FIG. 7B, the modifier 603 includes a smoother 731, a comparator 732, and a selector 733.

Effects of Invention

According to this embodiment, the temporary estimated second signal component is modified to generate the estimated second signal component N(k, n). Therefore, it is possible to prevent the power of the estimated second signal component N(k, n) from being extremely small (from being underestimated) at a frequency at which the phase difference Δθ(k, n) between the mixed signal spectra X1(*k, n*) and X2(*k, n*) is small. Accordingly, the second signal component (interfering sound component) can be estimated accurately and insufficient suppression of the second signal component is prevented, and thereby improving the quality of the enhanced signal as compared with the prior art.

In this embodiment, a case where the second signal component is suppressed using the null beamformer has been described. Alternatively, the present invention can also be applied to a technique for suppressing the second signal component included in the mixed signal to obtain an enhanced signal by giving a small gain to the signal for a large phase difference, like the technique described in NPL 1 and NPL 2. In this case, the suppressor 602 suppresses the second signal component based on the phase difference to obtain a temporary enhanced signal spectrum. The modifier 603 modifies the temporary enhanced signal spectrum using the method described in this embodiment, to obtain an enhanced signal spectrum. With this arrangement, the temporary enhanced signal spectrum is modified to obtain the enhanced signal spectrum, and thereby preventing insufficient suppression of the second signal component at a frequency at which the phase difference $\Delta\theta(k, n)$ is small. Accordingly, the quality of the enhanced signal is improved as compared with the prior art.

In the following embodiments, the case where the second signal component is suppressed using the null beamformer will be described. However, the present invention can also be applied to the technique for generating the enhanced signal by giving a small gain to the signal for a large phase difference. In this case, the enhanced signal spectrum can be obtained by the estimator 205, like in this embodiment.

Third Embodiment

Figure 8A:
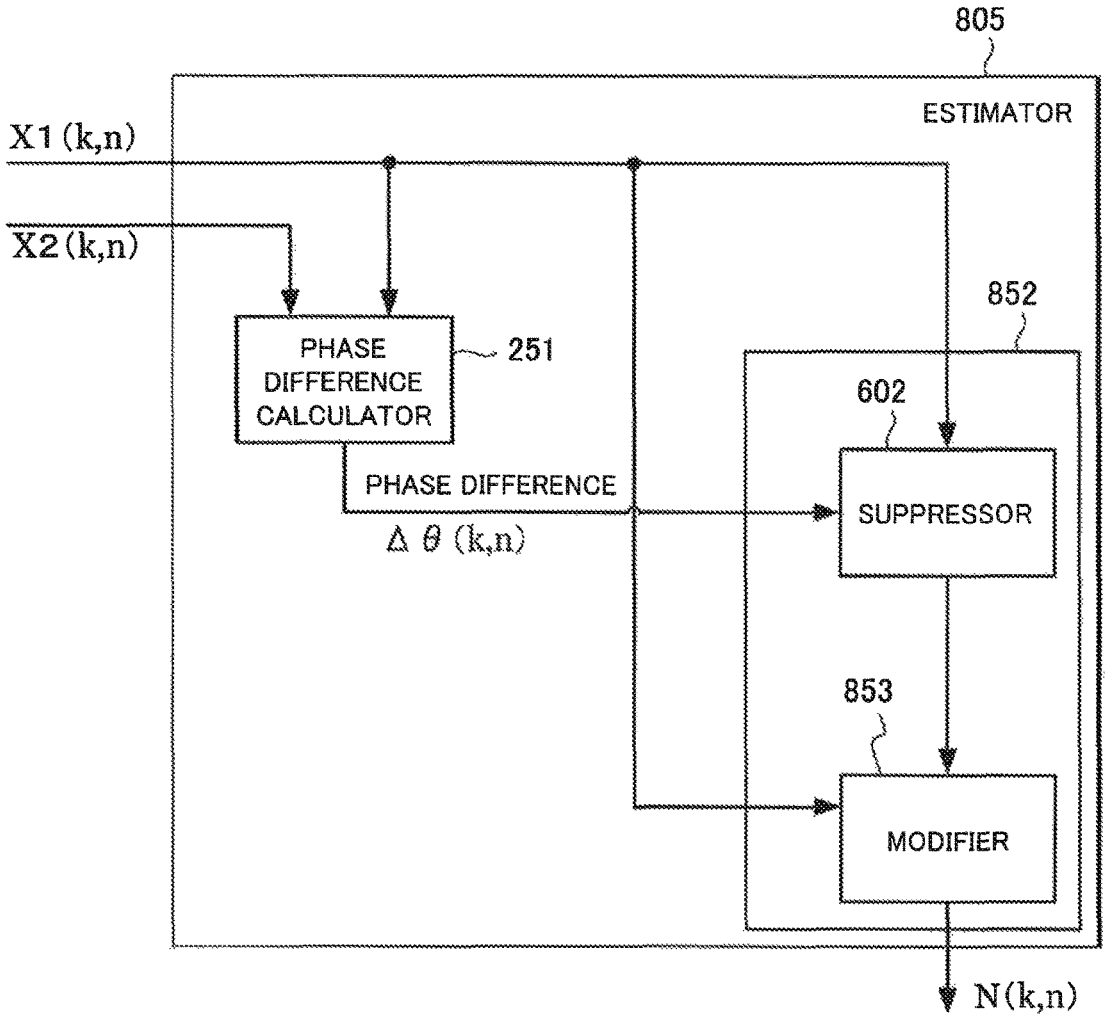
FIG. 8A is a block diagram showing an arrangement of the estimator in the signal processing apparatus according to the third embodiment of the present invention.

A signal processing apparatus according to the third embodiment of the present invention will be described with reference to FIGS. 8A and 8B. FIG. 8A is a block diagram showing an arrangement of an estimator 805 of the signal processing apparatus according to this embodiment. A modifier 853 according to this embodiment is different from the modifier 603 in the second embodiment in that the first input signal is input. The rest of the components and operations are the same as those in the second embodiment. Hence, the same reference numbers are used to denote the same components and operations, and a detailed description thereof will be omitted.

Figure 8B:
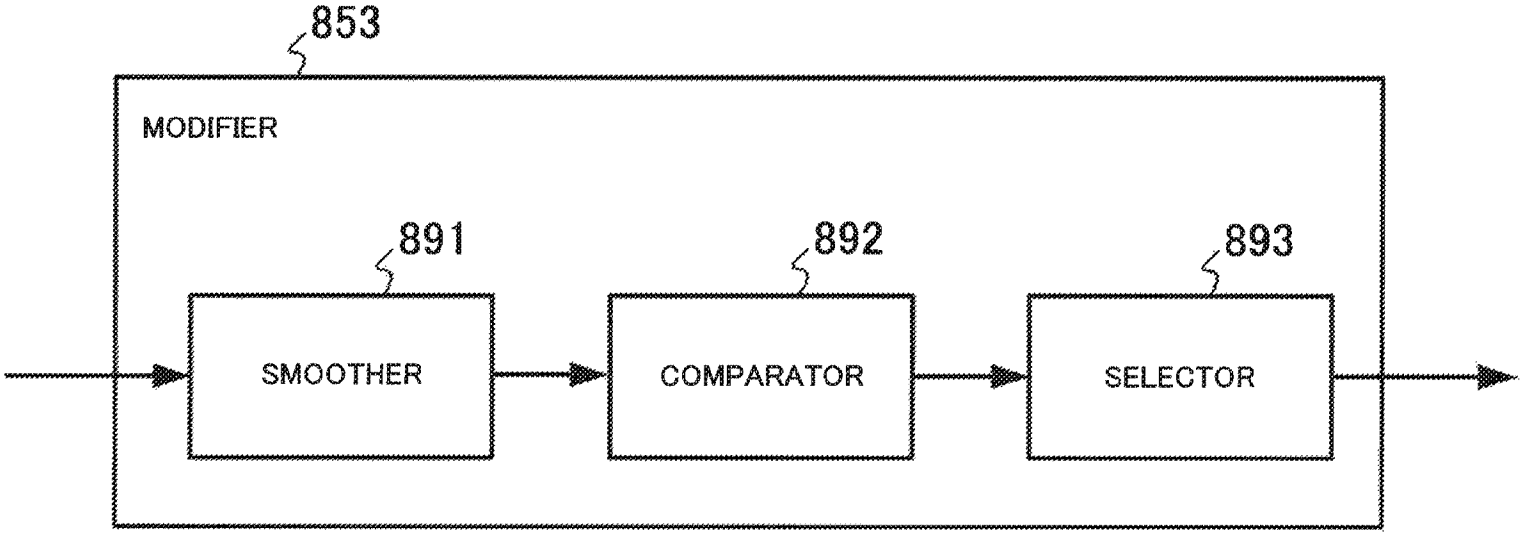
FIG. 8B is a block diagram showing an arrangement of the modifier in the signal processing apparatus according to the third embodiment of the present invention.

As shown in FIG. 8B, the modifier 853 includes a smoother 891, a comparator 892, and a selector 893. The modifier 853 modifies the temporary estimated second signal component supplied from the suppressor 602 using the mixed signal spectrum X1(*k, n*) supplied from the transformer 203 to generate an estimated second signal component N(k, n). The smoother 891 smooths the temporary estimated second signal component N bar(k, n) by the method described in the second embodiment. The comparator 892 compares the temporary estimated second signal component N bar(k, n) with a power PX1(*k, n*) of the mixed signal spectrum X1(*k, n*). When PX1(*k, n*) is smaller than N bar(k, n), the selector 893 uses PX1(*k, n*) as the estimated second signal component N(k, n) instead of the temporary estimated second signal component N bar(k, n). Otherwise, like in the second embodiment, the temporary estimated second signal component N bar(k, n) is used as the estimated second signal component N(k, n). Thus, overestimation of the second signal component caused by smoothing can be reduced as compared with the case where the replacement with the smoothed value is performed for every temporary estimated second signal component, like in the second embodiment. In this embodiment, the case where the mixed signal spectrum X1(*k, n*) is used has been described, but instead, the mixed signal spectrum X2(*k, n*) supplied from the transformer 204 may also be used. In either case, an equivalent performance can be obtained.

According to this embodiment, when modifying the temporary estimated second signal component to generate an estimated second signal component N(k, n), the mixed signal spectrum is also used for modification. Further, the mixed signal spectrum is compared with the smoothed temporary estimated second signal component, and an appropriate one of them is used as the estimated second signal component N(k, n). Therefore, according to this embodiment, it is possible to estimate the second signal component more accurately compared to the second embodiment, and thereby enhancing the quality of the enhanced signal.

Fourth Embodiment

Figure 9:
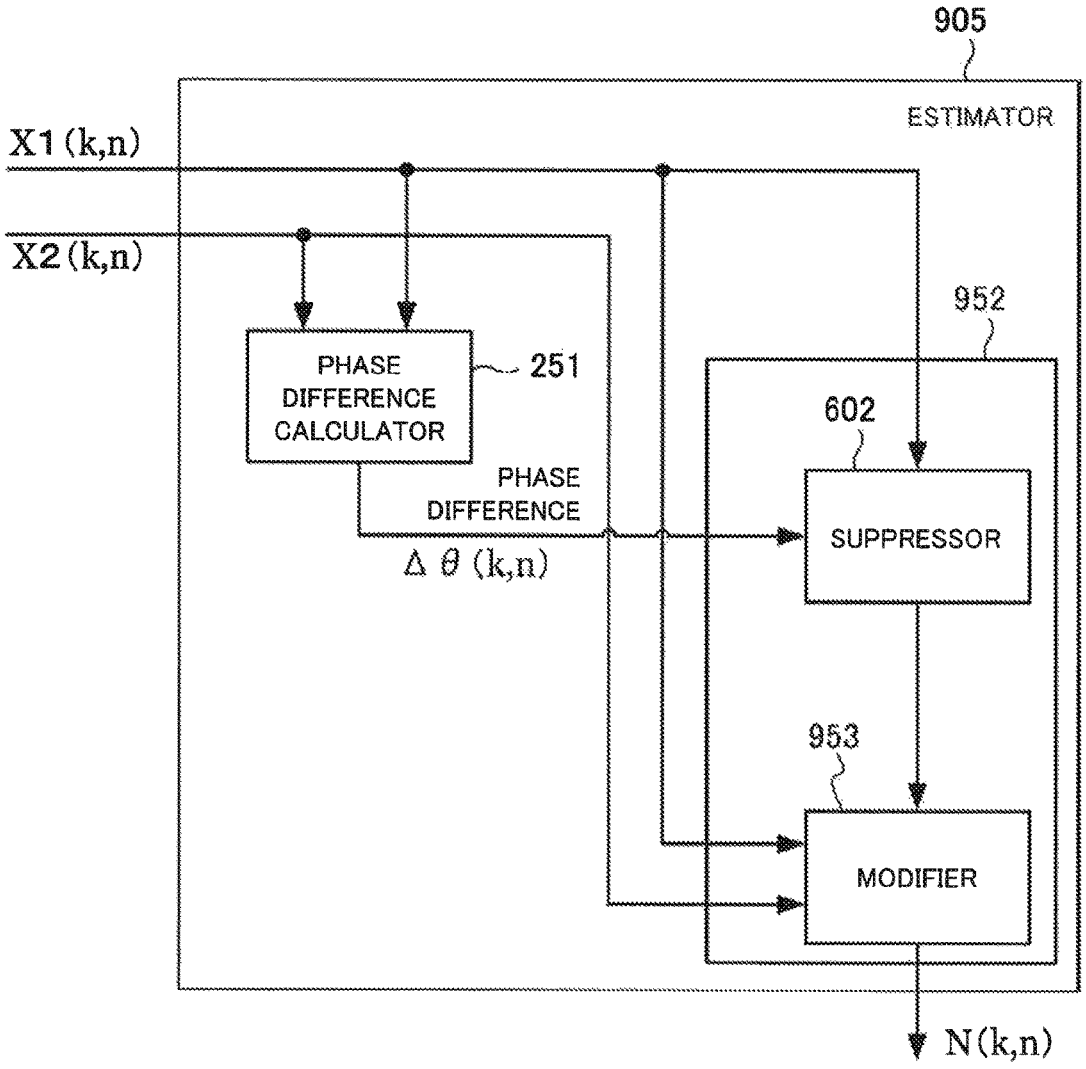
FIG. 9 is a block diagram showing an arrangement of the estimator in the signal processing apparatus according to the fourth embodiment of the present invention.

A signal processing apparatus according to the fourth embodiment of the present invention will be described with reference to FIG. 9. FIG. 9 is a block diagram showing an arrangement of an estimator 905 of the signal processing apparatus according to this embodiment. A modifier 953 according to this embodiment is different from the modifier 603 in the second embodiment in that the modifier 953 receives the first input signal and the second input signal. The rest of the components and operations are the same as in the second embodiment. Hence, the same reference numbers are used to denote the same components and operations, and a detailed description thereof will be omitted.

The modifier 953 modifies the temporary estimated second signal component supplied from the suppressor 602 using the mixed signal spectrum X1(*k, n*) supplied from the transformer 203 and the mixed signal spectrum X2(*k, n*) supplied from the transformer 204 to generate the estimated second signal component N(k, n). Unlike in the third embodiment, in addition to the mixed signal spectrum X1(*k, n*), the mixed signal spectrum X2(*k, n*) is also used for modification. Basically, three inputs of the smoothed temporary estimated second signal component and the mixed signal spectra X1(*k, n*) and X2(*k, n*) are used for comparing, mixing, and selecting to generate an estimated second signal component N(k, n). For example, there is a method of directly comparing the three inputs. When the temporary estimated second signal component smoothed by the method described in the second embodiment is represented by N bar(k, n) and the powers of the mixed signal spectra X1(*k, n*) and X2(*k, n*) are represented by PX1(*k, n*) and PX2(*k, n*), respectively, N bar(k, n), PX1(*k, n*), and PX2(*k, n*) are compared. A smallest value among them is used as the estimated second signal component N(k, n). This can reduce overestimation of the second signal component as compared with the second embodiment.

A method of comparing a mixture of PX1(*k, n*) and PX2(*k, n*) with N bar(k, n) is also effective. When the power of the mixed signal spectrum is represented by PX3(*k, n*), PX3(*k, n*) is given by the following equation.

$$PX3(k,n)=c(k,n)PX1(k,n)+d(k,n)PX2(k,n), \quad \text{[Equation 13]}$$

where c(k, n) and d(k, n) are real numbers. In order to prevent a big change in the power caused by mixing, it is preferable that the sum of c(k, n) and d(k, n) is equal to 1. Further, N bar(k, n) and PX3(*k, n*) are compared and a smaller one of them is used as the estimated second signal component N(k, n).

The mixing method is not limited to the weighted sum described above. For example, there is a method of expressing PX1(*k, n*) and PX2(*k, n*) as logarithmic values, and then calculating a weighted sum of the logarithmic values. At this time, after the weighted sum is calculated, the weighted sum is transformed into a linear domain signal by an exponential function. PX3(*k, n*) is given as follows.

$$PX3(k,n)==\exp(c(k,n)\log(PX1(k,n))+d(k,n)\log(PX2(k,n))), \quad \text{[Equation 14]}$$

where exp(•) and log(•) represent an exponential function and a logarithmic function, respectively. Calculating the weighted sum in a logarithmic domain allows to implement better mixing for hearing. Alternatively, a function represented in another form, such as a high-order polynomial function or a non-linear function, may also be used.

According to this embodiment, when modifying the temporary estimated second signal component to generate an estimated second signal component N(k, n), a plurality of mixed signal spectra are used for modification. Therefore, according to this embodiment, it is possible to estimate the second signal component more accurately compared to the second embodiment, and thereby improving the quality of the enhanced signal.

Fifth Embodiment

Figure 10A:
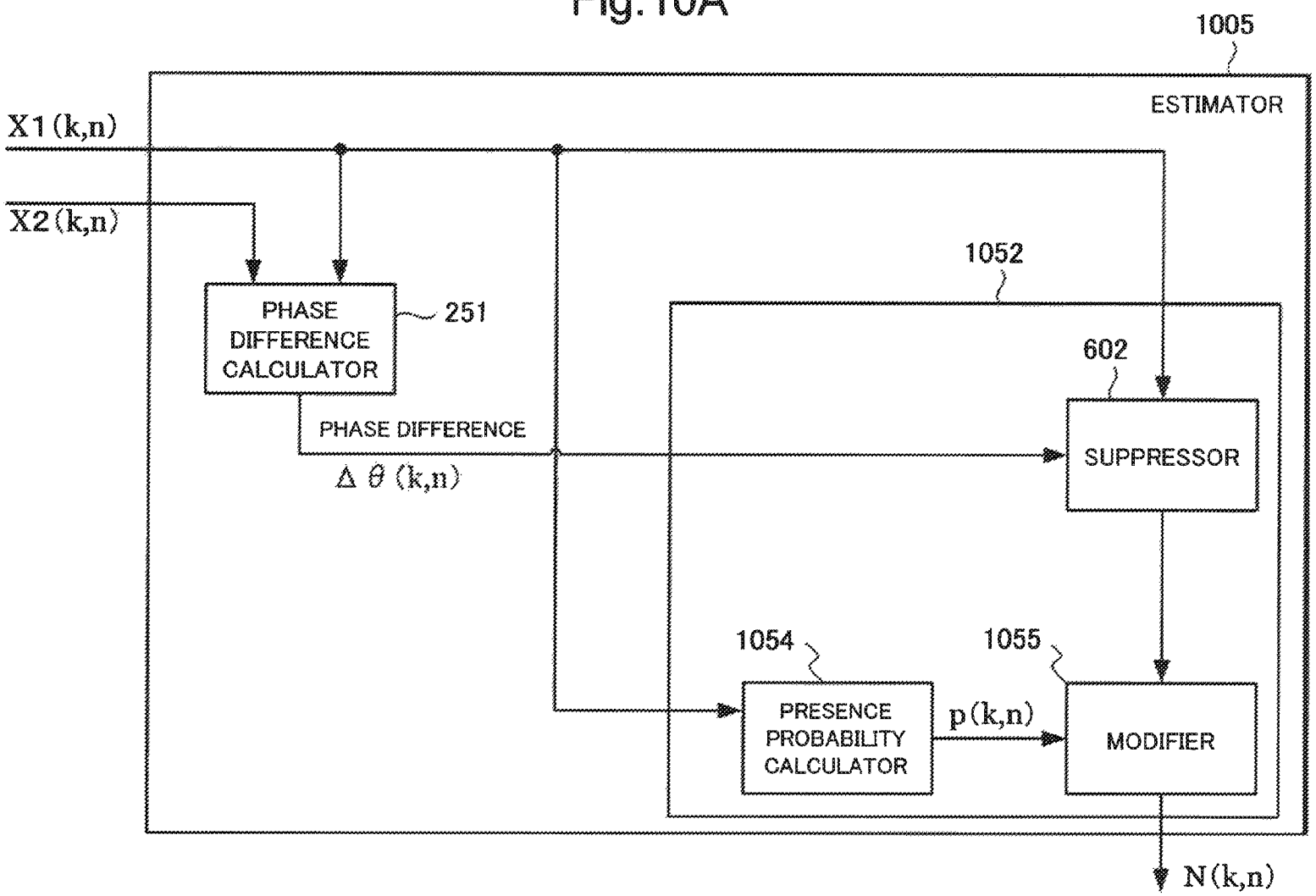
FIG. 10A is a block diagram showing an arrangement of the estimator in the signal processing apparatus according to the fifth embodiment of the present invention.

A signal processing apparatus according to the fifth embodiment of the present invention will be described with reference to FIG. 10A. FIG. 10A is a block diagram showing an arrangement of an estimator 1005 of the signal processing apparatus according to this embodiment. A generator 1052 according to this embodiment is different from the generator 252 according to the second embodiment in that the generator 1052 includes a presence probability calculator 1054 and a modifier 1055. The rest of the components and operations are the same as in the second embodiment. Hence, the same reference numbers are used to denote the same components and operations, and a detailed description thereof will be omitted.

The presence probability calculator 1054 calculates a probability (a presence probability) that the first signal component is included in the mixed signal spectrum X1(*k, n*) using the mixed signal spectrum X1(*k, n*) supplied from the transformer 203. The presence probability is a real number from 0 to 1. Basically, the presence probability is individually calculated for all frequencies. Alternatively, one presence probability may be calculated for a plurality of frequencies in order to reduce an amount of calculations.

When the target sound is a speech or music, a method using harmonic structure of a signal is effective. First, a fundamental frequency of the signal is obtained. As a method for calculating the fundamental frequency, for example, NPL8 to NPL 10 disclose an auto-correlation method, a method using a cestrum, and the like. Then, harmonic frequencies are obtained based on the obtained fundamental frequency. Each of the harmonic frequencies is a frequency at which a harmonic component exists. Because an integer multiple of the fundamental frequency corresponds to a harmonic frequency, harmonic frequencies for the fundamental frequency k0 are 2k0, 3k0, 4k0, . . . . Lastly, based on the obtained fundamental frequency and harmonic frequencies, a presence probability of the first signal component for each frequency is calculated. At the fundamental frequency and harmonic frequencies, the presence probability of the first signal component is set to 1. At a frequency close to the fundamental frequency or harmonic frequencies, the presence probability is set to a value close to 1. As the frequency is further away from the fundamental frequency or harmonic frequencies, the presence probability is set to a value closer to 0.

A method of calculating the presence probability of the first signal component for each frame is also effective. When the target sound is speech, a technique for determining the possibility of presence of the first signal component for each frame is referred to as "voice detection" (VAD: Voice Activity Detection). Various VAD methods are known as a technique. For example, NPL 11 discloses a method using a low frequency power, higher-order statistics of the signal, and harmonic structure and periodicity of the voice, and the like. When voice is detected as a result of voice detection, the presence probability is set to 1 over the entire band. With respect to frames in which no voice is detected, for M2 frames (where M2 is a positive integer) immediately after detection, the presence probability is set to a value close to 1. Further, as time passes, the presence probability is set to a value closer to 0.

Figure 10B:
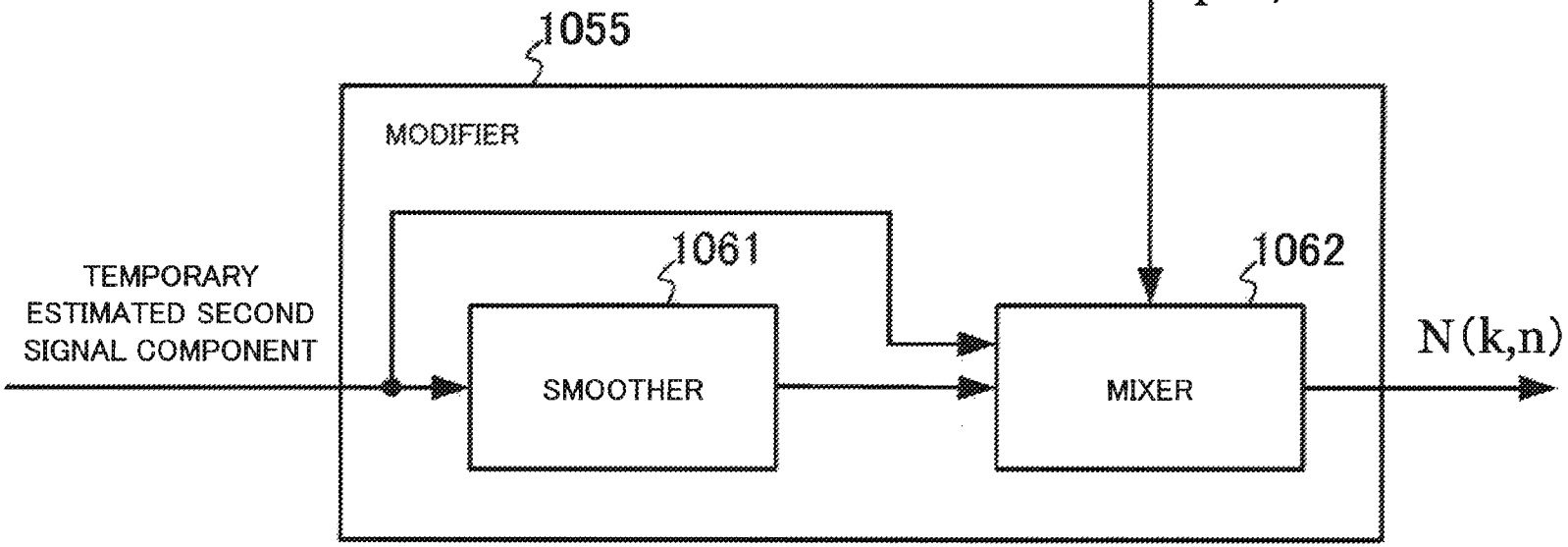
FIG. 10B is a block diagram showing an arrangement of the modifier in the signal processing apparatus according to the fifth embodiment of the present invention.

As shown in FIG. 10B, the modifier 1055 includes a smoother 1061 and a mixer 1062. The modifier 1055 modifies a temporary estimated second signal component supplied from the suppressor 602 using the presence probability supplied from the presence probability calculator 1054 to generate the estimated second signal component N(k, n). The smoother 1061 smooths the temporary estimated second signal component N bar(k, n) by the method described in the second embodiment. The mixer 1062 mixes the temporary estimated second signal components before and after smoothing according to a mixing ratio calculated based on the presence probability, and uses the mixed signal as the estimated second signal component N(k, n). When the presence probability is low, the mixer 1062 mixes the temporary estimated second signal component after smoothing at a high ratio. Accordingly, smoothing is performed only at a frequency at which the first signal component is less likely to exist. That is, an inappropriate modification is prevented in a band in which the first signal component exists, and thus overestimation of the second signal component can be prevented.

The mixing ratio is calculated by a monotone function whose variable is the presence probability. In the following, a case of using a linear function which is a basic example of the monotone function is described. When the presence probability is represented by p(k, n), a mixing ratio w(k, n) for the temporary estimated second signal component before smoothing is calculated by the following equation.

$$w(k,n)=\begin{cases}0, & ap(k,n)+b<0\\ 1, & ap(k,n)+b>1\\ ap(k,n)+b & \text{otherwise}\end{cases}, \qquad \text{[Equation 15]}$$

where a and b represent real numbers, and a>0 is satisfied. As is seen from the above equation, the mixing ratio is a real number from 0 to 1. When p(k, n) is sufficiently small, w(k, n) is set as w(k, n)=0, and thus the mixing ratio of the temporary estimated second signal component before smoothing is set to 0. Alternatively, the presence probability p(k, n) may be used as the mixing ratio without calculating the mixing ratio. In this case, because there is no need to calculate the mixing ratio, it is effective to reduce an amount of calculations.

When the temporary estimated second signal components before and after smoothing are represented by N1(*k, n*) and N2(*k, n*), respectively, the estimated second signal component N(k, n) is calculated by the following equation.

$$N(k,n)=w(k,n)N1(k,n)+(1-w(k,n))N2(k,n). \qquad \text{[Equation 16]}$$

The mixing method is not limited to the weighted sum described above. For example, there is a method of expressing N1(*k, n*) and N2(*k, n*) as logarithmic values and then calculating the weighted sum of the logarithmic values. At this time, after the weighted sum is calculated, the exponential function is used to transform the weighted sum into a linear domain signal. The estimated second signal component N(k, n) is given by the following equation.

$$N(k,n)=\exp(w(k,n)\log(N1(k,n))+(1-w(k,n)\log(N2(k,n)), \qquad \text{[Equation 17]}$$

where exp(•) and log(•) represent an exponential function and a logarithmic function, respectively. Calculating the weighted sum in a logarithmic domain allows to implement better mixing for hearing. Alternatively, a function represented in another form, such as a high-order polynomial or a non-linear function, may also be used.

According to this embodiment, the temporary estimated second signal component is modified using the presence probability of the first signal component. The modification is performed with an emphasis on the case where the presence probability of the first signal component is low. Therefore, according to this embodiment, it is possible to prevent an inappropriate modification at a frequency at which the presence probability of the first signal component is high, and thereby improving the accuracy of estimating the second signal component and the quality of the enhanced signal as compared with those of the second embodiment.

Sixth Embodiment

Figure 11:
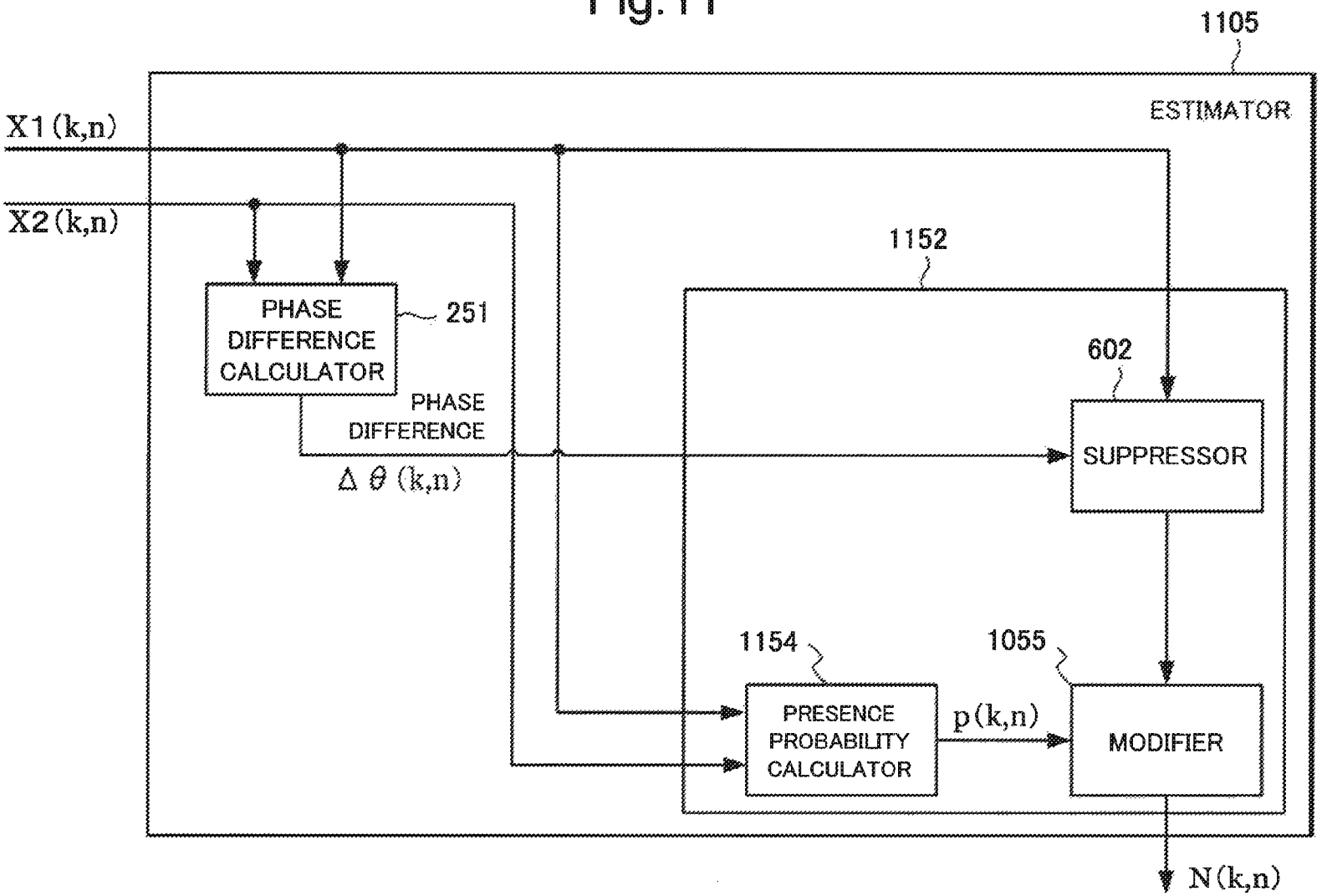
FIG. 11 is a block diagram showing an arrangement of the estimator in the signal processing apparatus according to the sixth embodiment of the present invention.

A signal processing apparatus according to the sixth embodiment of the present invention will be described with reference to FIG. 11. FIG. 11 is a block diagram showing an arrangement of an estimator 1105 of the signal processing apparatus according to this embodiment. A presence probability calculator 1154 according to this embodiment is different from the presence probability calculator 1054 according to the fifth embodiment in that the presence probability calculator 1154 receives the first input signal and the second input signal. The rest of the components and operations are the same as in the fifth embodiment. Hence, the same reference numbers are used to denote the same components and operations, and a detailed description thereof will be omitted.

The presence probability calculator 1154 calculates a probability of presence of the first signal component in the mixed signal spectra X1(*k, n*) and X2(*k, n*) using the mixed signal spectrum X1(*k, n*) supplied from the transformer 203 and the mixed signal spectrum X2(*k, n*) supplied from the transformer 204. In this embodiment, the presence probability p(k, n) is calculated using two mixed signal spectra X1(*k, n*) and X2(*k, n*).

A typical calculation method is to calculate a presence probability of the first signal component separately for each of the mixed signal spectra X1(*k, n*) and X2(*k, n*) and then integrate the calculated probabilities. When the target sound is speech or music, as described in the fifth embodiment, the presence probability p(k, n) for each of the mixed signal spectra X1(*k, n*) and X2(*k, n*) can be calculated by a method using the harmonic structure of the signal.

There are various methods for integrating presence probabilities. The simplest method is calculating a product of the presence probabilities. When the presence probabilities for two mixed signal spectra X1(*k, n*) and X2(*k, n*) are represented by p1(*k, n*) and p2(*k, n*), respectively, the presence probability p(k, n) output from the presence probability calculator 1154 is calculated by the following equation.

$$p(k,n)=p1(k,n)p2(k,n). \quad \text{[Equation 18]}$$

The method for integrating the presence probabilities p(k, n) is not limited to calculating a product. For example, a method using a weighted sum of p1(*k, n*) and p2(*k, n*) is also effective. In this case, p(k, n) is calculated by the following equation.

$$p(k,n)=\frac{a(k,n)p1(k,n)+b(k,n)p2(k,n)}{a(k,n)+b(k,n)}, \quad \text{[Equation 19]}$$

where a(k, n) and b(k, n) are positive real numbers. A degree of influence by p1(*k, n*) and p2(*k, n*) can be controlled by values of a(k, n) and b(k, n). For example, when a(k, n)=0.01 and b(k, n)=0.99, p(k, n) highly depends on p2(*k, n*).

It is also effective to calculate the presence probability p(k, n) after integrating the mixed signal spectra X1(*k, n*) and X2(*k, n*), instead of integrating presence probabilities that are separately obtained. Because the presence probability is calculated only once, an amount of calculations is reduced as compared to the case where presence probabilities are separately calculated. For integrating the mixed signal spectra X1(*k, n*) and X2(*k, n*), a weighted sum may be used. A mixed signal spectrum XM(k, n) after integration is calculated by the following equation.

$$XM(k,n)=\frac{a(k,n)X1(k,n)+b(k,n)X2(k,n)}{a(k,n)+b(k,n)}, \quad \text{[Equation 20]}$$

where a(k, n) and b(k, n) are positive real numbers. For calculating the presence probability p(k, n) based on the integrated mixed signal spectrum XM(k, n), the method using the harmonic structure of the signal, as described in the fifth embodiment, may be directly applied.

In the case of calculating the presence probability of the first signal component using a plurality of mixed signal spectra, a calculation method based on a correlation between the mixed signal spectra is also effective. A typical example is a method using a cross-correlation between the mixed signal spectra. In this case, the cross-correlation between the mixed signal spectra X1(*k, n*) and X2(*k, n*) is calculated, and when the correlation value is high, the presence probability p(k, n) of the first signal component is set to a large value. For example, it is known that the correlation is low for environmental noise or ambient noise. Thus, using the correlation is an effective method when the target sound is speech or music and the interfering sound is environmental noise or ambient noise. As a method for calculating the correlation, various methods are known. For example, NPL4 and NPL5 disclose a cross-correlation method, a cross-spectral power analysis method, GCC-PHAT, and the like.

A method using a relative relation between powers or phases of mixed signal spectra is also effective. In a method using a relative relation between powers, when the powers of the mixed signal spectra X1(*k, n*) and X2(*k, n*) are close to each other, it is determined to be the first signal component. Otherwise, it is determined to be the second signal component. For example, when a ratio between the powers of the mixed signal spectra is close to 1, the presence probability of the first signal component is set to a large value, or when a difference between the powers is close to 0, the presence probability of the first signal component is set to a large value. In the method using a relative relation between phases, when a difference between the phases is small, the presence probability of the first signal component is set to a large value. It is possible to use the phase difference calculated by the phase difference calculator 251. In this case, there is no need for the presence probability calculator 1154 to calculate the phase difference.

According to this embodiment, when calculating the presence probability of the first signal component, two mixed signal spectra X1(*k, n*) and X2(*k, n*) are used. Therefore, according to this embodiment, it is possible to calculate the presence probability p(k, n) more accurately compared to the fifth embodiment in which only one mixed signal spectrum X1(*k, n*) has been used, and thereby improving the accuracy of estimating the second signal component and the quality of the enhanced signal.

Seventh Embodiment

Figure 12:
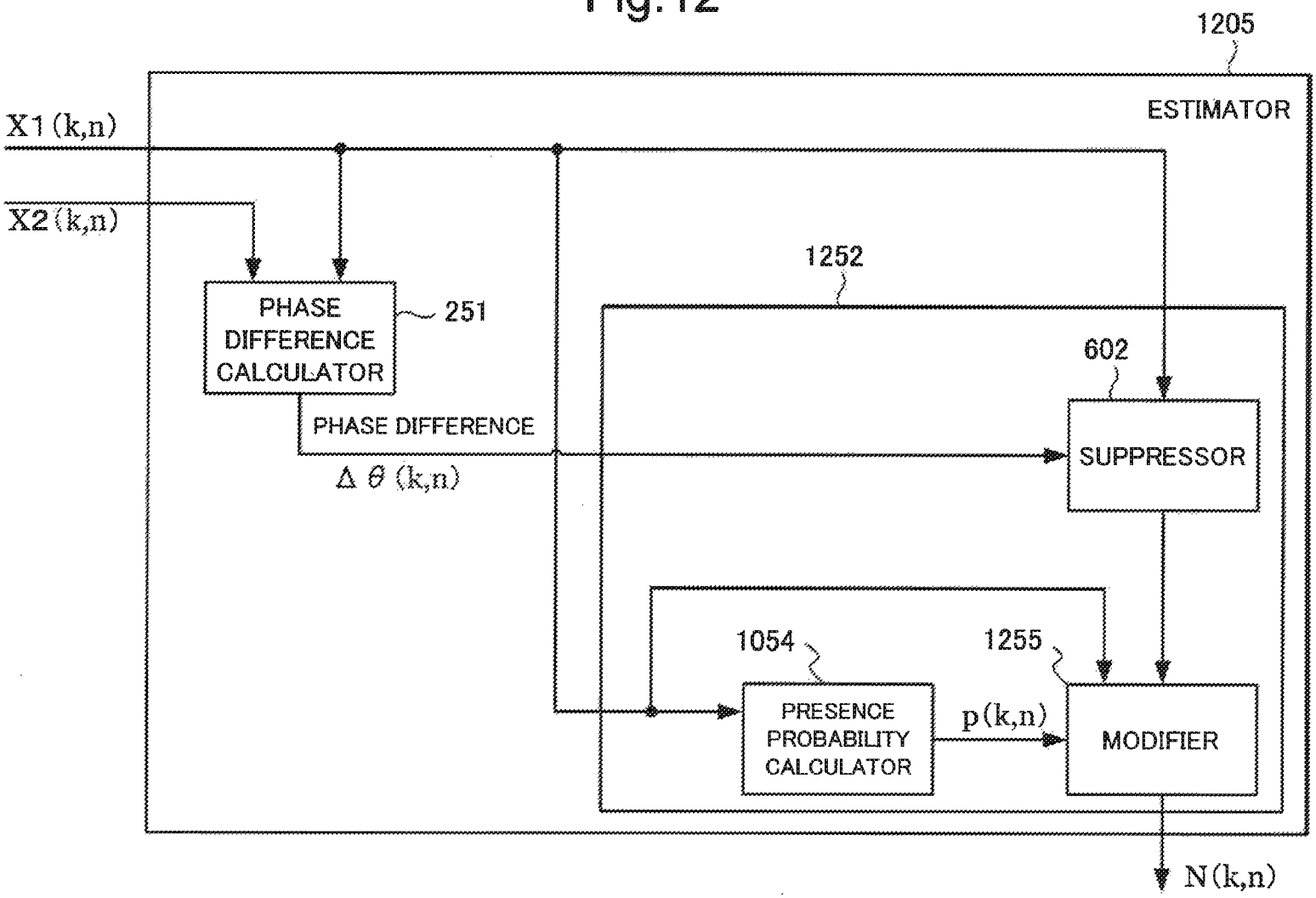
FIG. 12 is a block diagram showing an arrangement of the estimator in the signal processing apparatus according to the seventh embodiment of the present invention.

A signal processing apparatus according to the seventh embodiment of the present invention will be described with reference to FIG. 12. FIG. 12 is a block diagram showing an arrangement of an estimator 1205 of the signal processing apparatus according to this embodiment. A modifier 1255 according to this embodiment is different from the modifier 1055 according to the fifth embodiment in that the modifier 1255 receives the first input signal. The rest of the components and operations are the same as in the fifth embodiment. Hence, the same reference numbers are used to denote the same components and operations, and a detailed description thereof will be omitted.

The modifier 1255 modifies a temporary estimated second signal component supplied from the suppressor 602 using the mixed signal spectrum X1(*k, n*) supplied from the transformer 203 and the presence probability p(k, n) supplied from the presence probability calculator 1054 to generate an estimated second signal component N(k, n). Alternatively, using the mixed signal spectrum X2(*k, n*) supplied from the transformer 204, instead of using the mixed signal spectrum X1(*k, n*), allows to obtain similar effects.

First, the smoothed temporary estimated second signal component is modified by the method described in the second embodiment. Then, according to the mixing ratio obtained based on the presence probability p(k, n), the mixed signal spectrum X1(*k, n*) is mixed with the smoothed temporary estimated second signal component to generate the estimated second signal component N(k, n). When the presence probability p(k, n) is low, the first signal component is less likely to be included in the mixed signal spectrum X1(*k, n*), and thus the ratio of the mixed signal spectrum X1(*k, n*) is set to a large value. This prevents smoothing at a frequency at which the presence probability of the first signal component is low. Therefore, the accuracy of estimating the second signal component is improved. A main difference between the seventh embodiment and the second embodiment is that the presence probability p(k, n) is used for mixing of the mixed signal spectrum X1(*k, n*) and the smoothed temporary estimated second signal component.

For mixing, the method using the harmonic structure of a signal, as described in the fifth embodiment, is used. First, the mixing ratio is calculated based on the presence probability p(k, n). Then, the mixed signal spectrum and the smoothed temporary estimated second signal component are mixed based on the calculated mixing ratio. When the smoothed temporary estimated second signal component, the power of the mixed signal spectrum X1(*k, n*), and the mixing ratio are represented by N bar(k, n), PX1(*k, n*), and w(k, n), respectively, the estimated second signal component N(k, n) is calculated by the following equation.

$$N(k,n)=(1-w(k,n))PX1(k,n)+w(k,n)N\mathrm{bar}(k,n), \quad \text{[Equation 21]}$$

where w(k, n) is calculated by the method using a monotone function whose variable is the presence probability, as described in the fifth embodiment. As described in the fifth embodiment, when the presence probability p(k, n) is low, w(k, n) is small. In this case, the ratio of X1(*k, n*) to N(k, n) is large as is seen from the above equation. Alternatively, the presence probability p(k, n) may be used as the mixing ratio, without calculating the mixing ratio. Because there is no need to calculate the mixing ratio, it is effective to reduce an amount of calculations.

The method for calculating the estimated second signal component N(k, n) is not limited to the method in which the mixed signal spectrum X1(*k, n*) and the smoothed temporary estimated second signal component are mixed based on the presence probability p(k, n). A method of combining the third and fifth embodiments is also effective. In this case, first, like the third embodiment, the smoothed temporary estimated second signal component N bar(k, n) is compared with the power PX1(*k, n*) of the mixed signal spectrum X1(*k, n*). If PX1(*k, n*) is smaller than N bar(k, n), N bar(k, n) is set as N bar(k, n)=PX1(*k, n*). Then, according to the presence probability p(k, n), the modified temporary estimated second signal component is mixed with the temporary estimated second signal component before smoothing, and the mixed temporary estimated second signal component is used as the estimated second signal component N(k, n).

As the mixing method, the method of calculating the weighted sum of the temporary estimated second signal components before and after smoothing, N1(*k, n*), N2 (*k, n*), as described in the fifth embodiment, may be used. However, the seventh embodiment is different from the fifth embodiment in that mixing is performed using the temporary estimated second signal component that is further modified after smoothing, instead of using the temporary estimated second signal component immediately after smoothing.

According to this embodiment, the temporary estimated second signal component is modified using not only the presence probability p(k, n), but also the mixed signal spectrum X1(*k, n*). Further, at a frequency at which the presence probability p(k, n) is low, the estimated second signal component N(k, n) is generated with more emphasis on the mixed signal spectrum X1(*k, n*) than the smoothed temporary estimated second signal component. Therefore, according to this embodiment, it is possible to estimate the second signal component more accurately compared to the fifth embodiment in which only the presence probability p(k, n) is used for modification of the temporary estimated second signal component, and thereby improving the quality of the enhanced signal.

Eighth Embodiment

Figure 13:
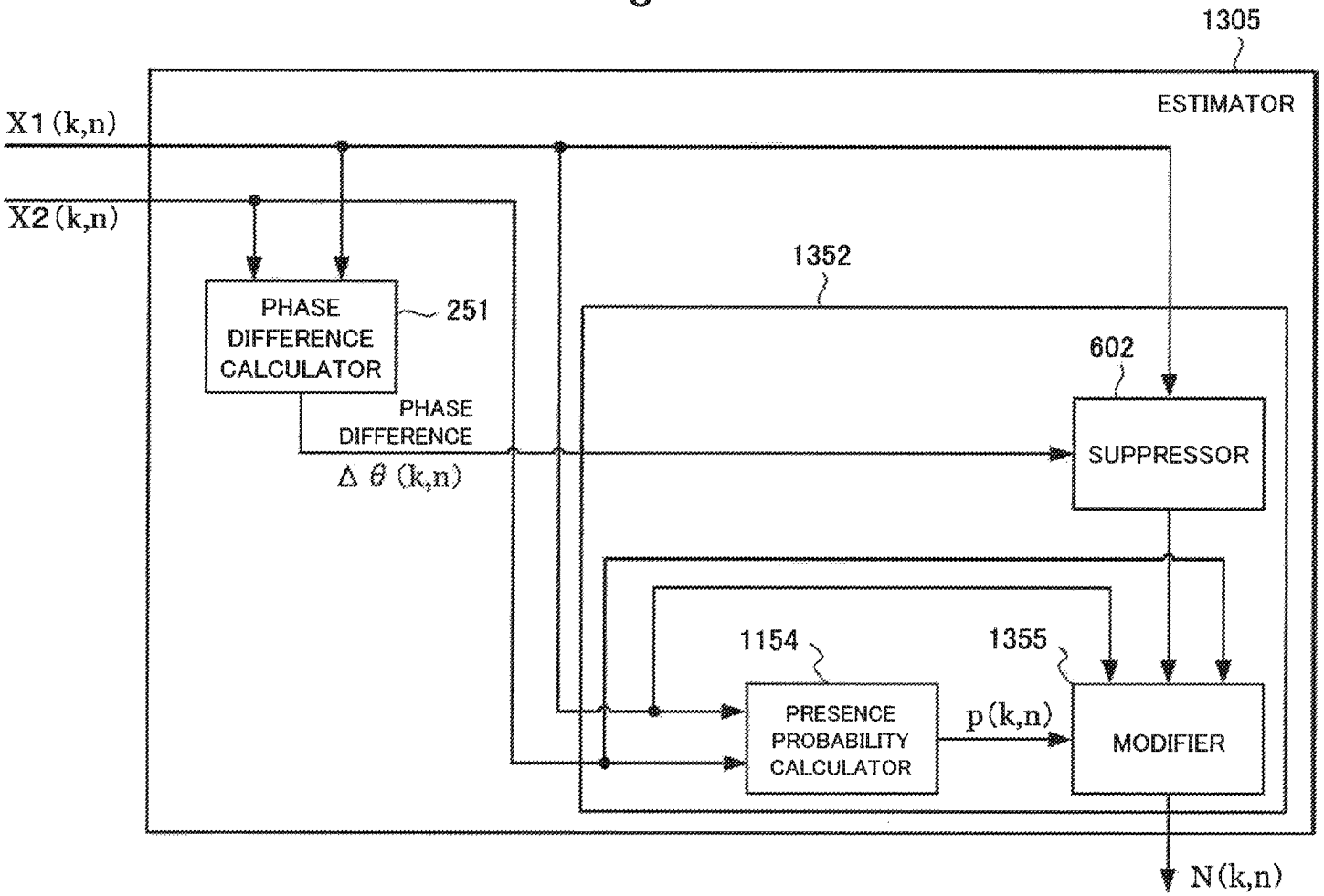
FIG. 13 is a block diagram showing an arrangement of the estimator in the signal processing apparatus according to the eighth embodiment of the present invention.

A signal processing apparatus according to the eighth embodiment of the present invention will be described with reference to FIG. 13. FIG. 13 is a block diagram showing an arrangement of an estimator 1305 of the signal processing apparatus according to this embodiment. A modifier 1355 according to this embodiment is different from the modifier 1055 according to the sixth embodiment in that the modifier 1355 receives the first input signal and the second input signal. The rest of the components and operations are the same as in the sixth embodiment. Hence, the same reference numbers are used to denote the same components and operations, and a detailed description thereof will be omitted.

The modifier 1355 modifies the temporary estimated second signal component supplied from the suppressor 602 using the mixed signal spectrum X1(*k, n*), the mixed signal spectrum X2(*k, n*), and the presence probability p(k, n) supplied from the presence probability calculator 1154 to generate the estimated second signal component N(k, n).

A main difference between the eighth embodiment and the sixth embodiment is that processing for mixing the mixed signal spectra is added. As a method for mixing the mixed signal spectra, the method of obtaining the weighted sum of the powers of the mixed signal spectrum X1(*k, n*) and the mixed signal spectrum X2(*k, n*), as described in the fourth embodiment, may be used. When the powers of the mixed signal spectrum X1(*k, n*) and the mixed signal spectrum X2(*k, n*) are represented by PX1(*k, n*) and PX2(*k, n*), respectively, the mixed signal spectrum power PX3(*k, n*) is given as follows.

$$PX3(k,n)=c(k,n)PX1(k,n)+d(k,n)PX2(k,n), \quad \text{[Equation 22]}$$

where c(k, n) and d(k, n) are real numbers. In order to prevent a great change in the power caused by mixing, it is preferable that the sum of c(k, n) and d(k, n) is equal to 1.

Then, like in the seventh embodiment, the mixed signal spectrum is mixed with the smoothed temporary estimated second signal component by the mixing method using the weighted sum. When the smoothed temporary estimated second signal component and the mixing ratio are represented by N bar(k, n) and w(k, n), respectively, the estimated second signal component N(k, n) is calculated as follows.

$$N(k,n)=(1-w(k,n))PX3(k,n)+w(k,n)N\text{bar}(k,n), \quad \text{[Equation 23]}$$

where w(k, n) is calculated by the method using a monotone function whose variable is the presence probability based on the presence probability p(k, n) as described in the fifth embodiment. As described in the seventh embodiment, when the presence probability p(k, n) is low, w(k, n) is small. Accordingly, the ratio of PX3(*k, n*) to N(k, n) is large.

The method for calculating the estimated second signal component N(k, n) is not limited to the method of mixing the mixed signal spectrum and the smoothed temporary estimated second signal component based on the presence probability p(k, n). A method of combining the fourth and sixth embodiments is also effective. In this case, first, like the fourth embodiment, the smoothed temporary estimated second signal component is modified. For example, the temporary estimated second signal component before smoothing, the power PX1(*k, n*) of the mixed signal spectrum X1(*k, n*), and the power PX2(*k, n*) of the mixed signal spectrum X2(*k, n*) are compared, and the smallest value is used as the modified value. Then, according to the presence probability p(k, n), the modified temporary estimated second signal component and the temporary estimated second signal component before smoothing are mixed, and the mixed temporary estimated second signal component is used as the estimated second signal component N(k, n). As the mixing method, the weighted sum may be used as described in the sixth embodiment. However, the eighth embodiment is different from the sixth embodiment in that mixing is performed using the temporary estimated second signal component that is further modified after smoothing, instead of using the temporary estimated second signal component immediately after smoothing.

According to this embodiment, the temporary estimated second signal component is modified using not only the presence probability p(k, n), but also a plurality of mixed signal spectra. Therefore, according to this embodiment, it is possible to estimate the second signal component more accurately, compared to the sixth embodiment using only the presence probability p(k, n) for modification of the temporary estimated second signal component, and thereby improving the quality of the enhanced signal.

Ninth Embodiment

Figure 14:
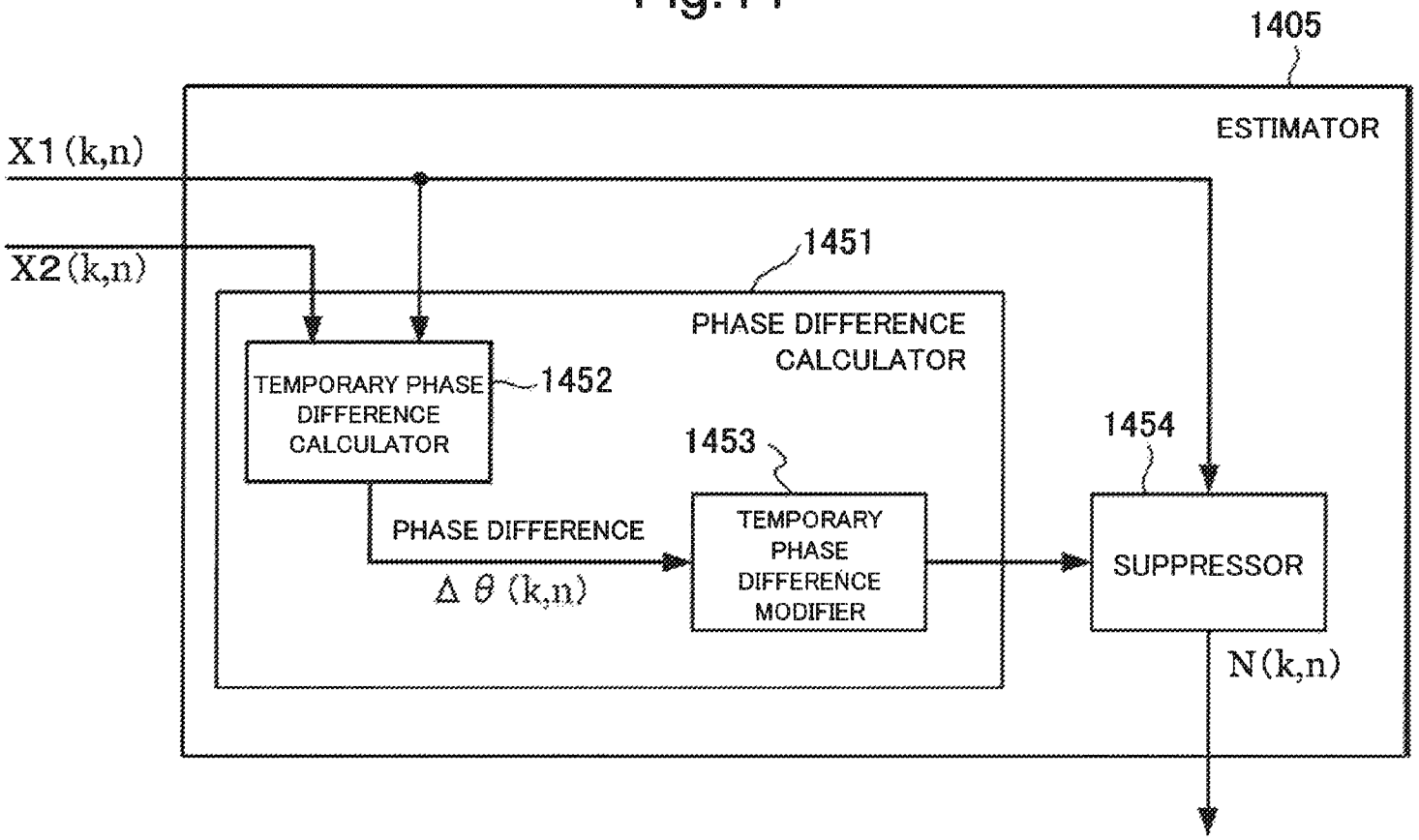
FIG. 14 is a block diagram showing an arrangement of the estimator in the signal processing apparatus according to the ninth embodiment of the present invention.

A signal processing apparatus according to the ninth embodiment of the present invention will be described with reference to FIG. 14. FIG. 14 is a block diagram showing an arrangement of an estimator 1405 of the signal processing apparatus according to this embodiment. The phase difference calculator 1451 included in the estimator 1405 according to this embodiment is different from the phase difference calculator 251 according to the second embodiment in that the phase difference calculator 1451 includes a temporary phase difference calculator 1452 and a temporary phase difference modifier 1453. The rest of the components and operations are the same as in the second embodiment. Hence, the same reference numbers are used to denote the same components and operations, and a detailed description thereof will be omitted.

The temporary phase difference calculator 1452 calculates a phase difference between the phase of the mixed signal spectrum X1(*k, n*) supplied from the transformer 203 and the phase of the mixed signal spectrum X2(*k, n*) supplied from the transformer 204, and outputs the calculated phase difference as a temporary phase difference.

The temporary phase difference modifier 1453 modifies the temporary phase difference supplied from the temporary phase difference calculator 1452 to obtain the phase difference, and supplies the phase difference to the suppressor 1454. The temporary phase difference modifier 1453 basically analyzes the temporary phase difference $\Delta\theta(k, n)$ to estimate the presence possibility of the first signal component, and modifies the phase difference based on the presence possibility. For example, the phase differences in the high frequency band are replaced with an average value of the phase differences. If the first signal component is large, the average value of the phase differences is close to zero, and thus the phase differences are replaced with a value close to zero by the modification.

A method of counting frequencies at which a phase difference has a value close to zero and then modifying phase differences based on the count is also effective. When the count is small, the first signal component is less likely to exist. In this case, the phase differences are modified to have a large absolute value away from zero at all frequencies.

The suppressor 1454 generates the estimated second signal N(k, n) by suppressing the first signal component included in the mixed signal spectrum X1(*k, n*) supplied from the transformer 203 based on the phase difference supplied from the temporary phase difference modifier 1453.

According to this embodiment, the temporary phase difference is modified to obtain the phase difference. Although this embodiment is different from the second embodiment in which the estimated second signal component N(k, n) is directly modified, the accuracy of estimating the second signal component is improved by modifying the phase difference. Therefore, according to this embodiment, it is possible to improve the quality of the enhanced signal like in the second embodiment, as compared with the case where the modification is not performed.

Tenth Embodiment

Figure 15:
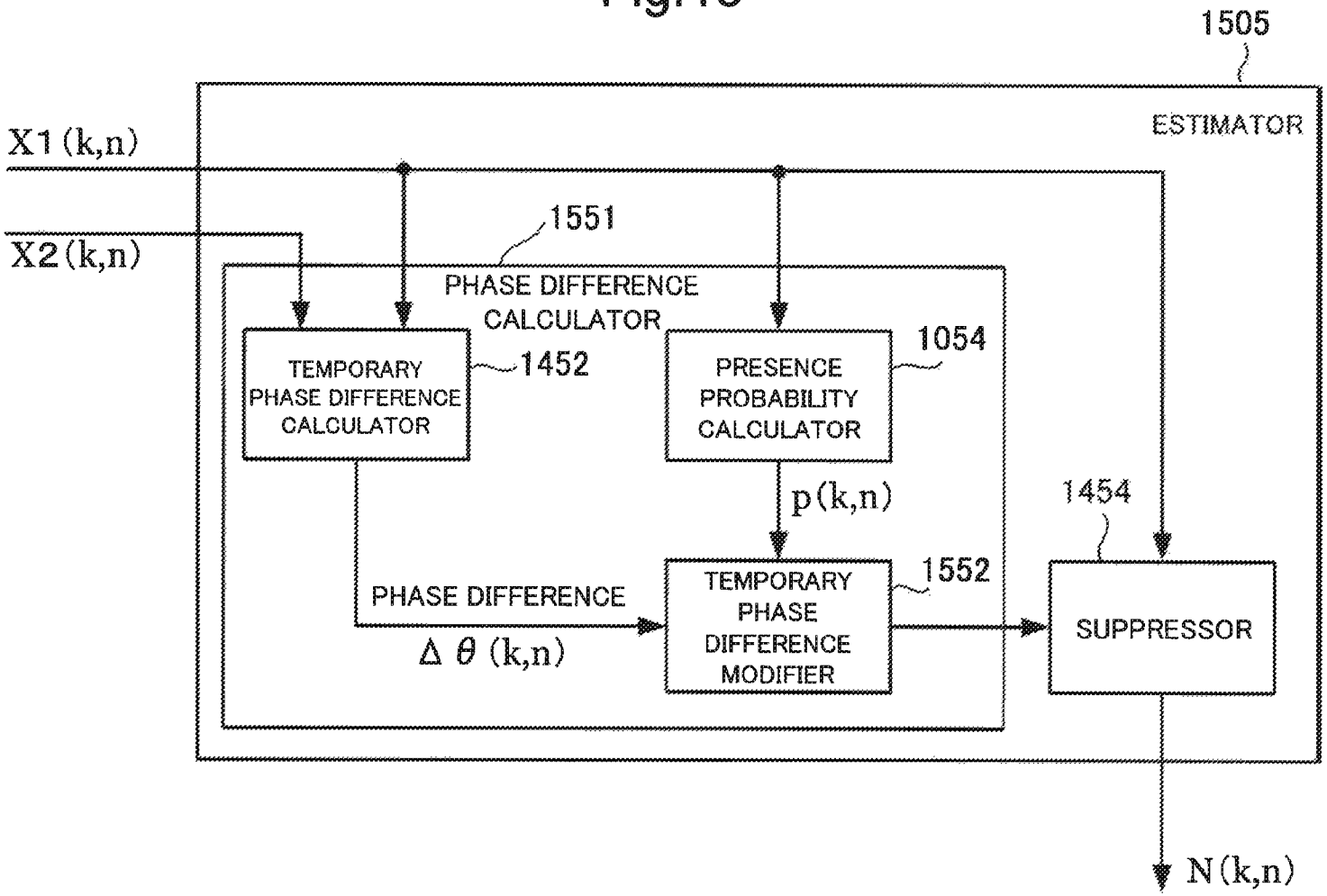
FIG. 15 is a block diagram showing an arrangement of the estimator in the signal processing apparatus according to the tenth embodiment of the present invention.

A signal processing apparatus according to the tenth embodiment of the present invention will be described with reference to FIG. 15. FIG. 15 is a block diagram showing an arrangement of an estimator 1505 of the signal processing apparatus according to this embodiment. The estimator 1505 according to this embodiment is different from the estimator 1405 according to the ninth embodiment in that a phase difference calculator 1551 includes a presence probability calculator 1054. The rest of the components and operations are the same as in the ninth embodiment. Hence, the same reference numbers are used to denote the same components and operations, and a detailed description thereof will be omitted.

The phase difference modifier 1552 obtains a phase difference by modifying the temporary phase difference supplied from the temporary phase difference calculator 1452 using the presence probability p(k, n) supplied from the presence probability calculator 1054. When the presence probability of the first signal component is high, an absolute value of the phase difference is set to a small value. When the presence probability of the first signal component is represented by p(k, n), the modified phase difference Δθ bar(k, n) is given as follows.

$$\Delta\theta\mathrm{bar}(k,n)=F(1-p(k,n))\Delta\theta(k,n)$$

where F(x) is a monotonously increasing function of x and F(x)>0 is satisfied. As p(k, n) is closer to 1, F(1−p(k, n)) becomes small.

According to this embodiment, the phase difference is modified using the presence probability of the first signal component. Therefore, according to this embodiment, it is possible to modify the phase difference more accurately, compared to the ninth embodiment in which the presence probability of the first signal component is not used, and thereby improving the accuracy of estimating the second signal component and the quality of the enhanced signal.

Note that like in the sixth embodiment, the presence probability calculator 1054 may calculate the presence probability using two or more mixed signal spectra.

Eleventh Embodiment

Figure 16:
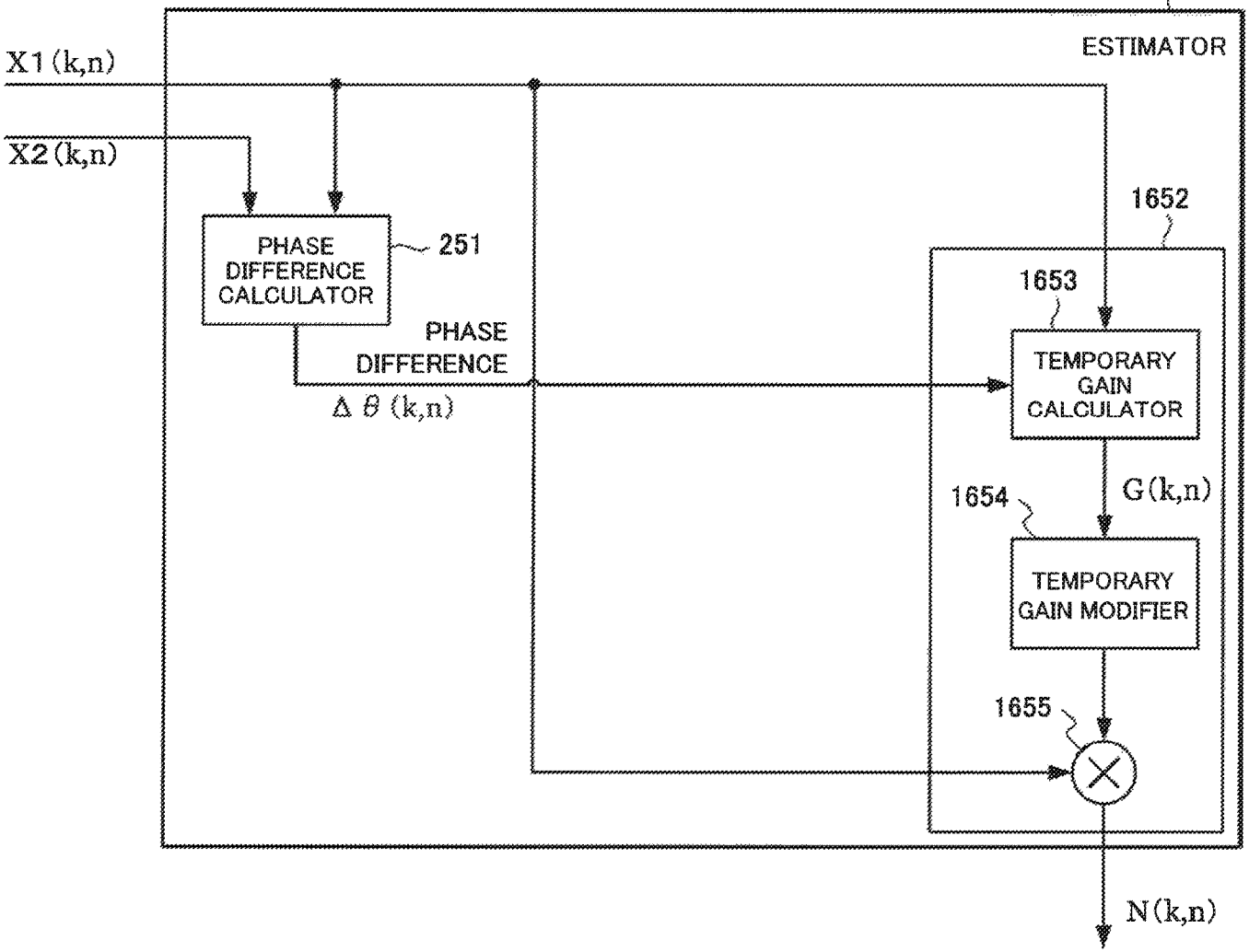
FIG. 16 is a block diagram showing an arrangement of the estimator in the signal processing apparatus according to the eleventh embodiment of the present invention.

A signal processing apparatus according to the eleventh embodiment of the present invention will be described with reference to FIG. 16. FIG. 16 is a block diagram showing an arrangement of an estimator 1605 of the signal processing apparatus according to this embodiment. The estimator 1605 according to this embodiment is different from the estimator 205 according to the second embodiment in that the estimator 1605 includes an estimated interfering sound generator 1652 having a temporary gain calculator 1653, a temporary gain modifier 1654, and a multiplier 1655. The rest of the components and operations are the same as in the second embodiment. Hence, the same reference numbers are used to denote the same components and operations, and a detailed description thereof will be omitted.

The temporary gain calculator 1653 calculates a temporary gain using the phase difference supplied from the phase difference calculator 251 and the mixed signal spectrum X1(*k, n*) supplied from the transformer 203. As a method for calculating the temporary gain based on the phase difference, the method using the function as described in the second embodiment may be used. Specifically, the temporary gain is calculated based on the phase difference using the gain function shown in FIG. 7.

The temporary gain modifier 1654 obtains a gain by modifying the temporary gain supplied from the temporary gain calculator 1653. Basically, the temporary gain is analyzed to estimate the presence possibility of the first signal component, and the temporary gain is modified based on the possibility. For example, gains in the high frequency band are replaced with an average value of the gains in the band therein. When there are a few first signal components, the average value of the gains is close to 1, and thus the gains are replaced with a value close to 1 by the modification.

A method of counting the number of frequencies at which the gain has a value close to 1, and then modifying the gains based on the count is also effective. When the count is large, the first signal component is less likely to exist. In this case, the gains are modified to a large value close to 1 at all frequencies.

The multiplier 1655 multiplies the mixed signal spectrum X1(*k, n*) supplied from the transformer 203 by the gain supplied from the temporary gain modifier 1654 to generate the estimated second signal component N(k, n). When the power of the mixed signal spectrum X1(*k, n*) and the modified gain are represented by PX1(*k, n*) and G bar(k, n), respectively, the estimated second signal component N(k, n) is given by the following equation.

$$N(k,n)=Gbr(k,n)PX1(k,n). \qquad \text{[Equation 25]}$$

Alternatively, when the multiplier 1655 uses the mixed signal spectrum X2(*k, n*) supplied from the transformer 204, instead of using the mixed signal spectrum X1(*k, n*), similar effects can be obtained.

According to this embodiment, the temporary gain is modified to obtain the gain. Although this embodiment is different from the second embodiment in which the estimated second signal component N(k, n) is modified, the accuracy of estimating the second signal component can be improved by modifying the gain. Therefore, according to this embodiment, it is possible to improve the quality of the enhanced signal like in the second embodiment, as compared to the case where the modification is not performed.

Twelfth Embodiment

Figure 17:
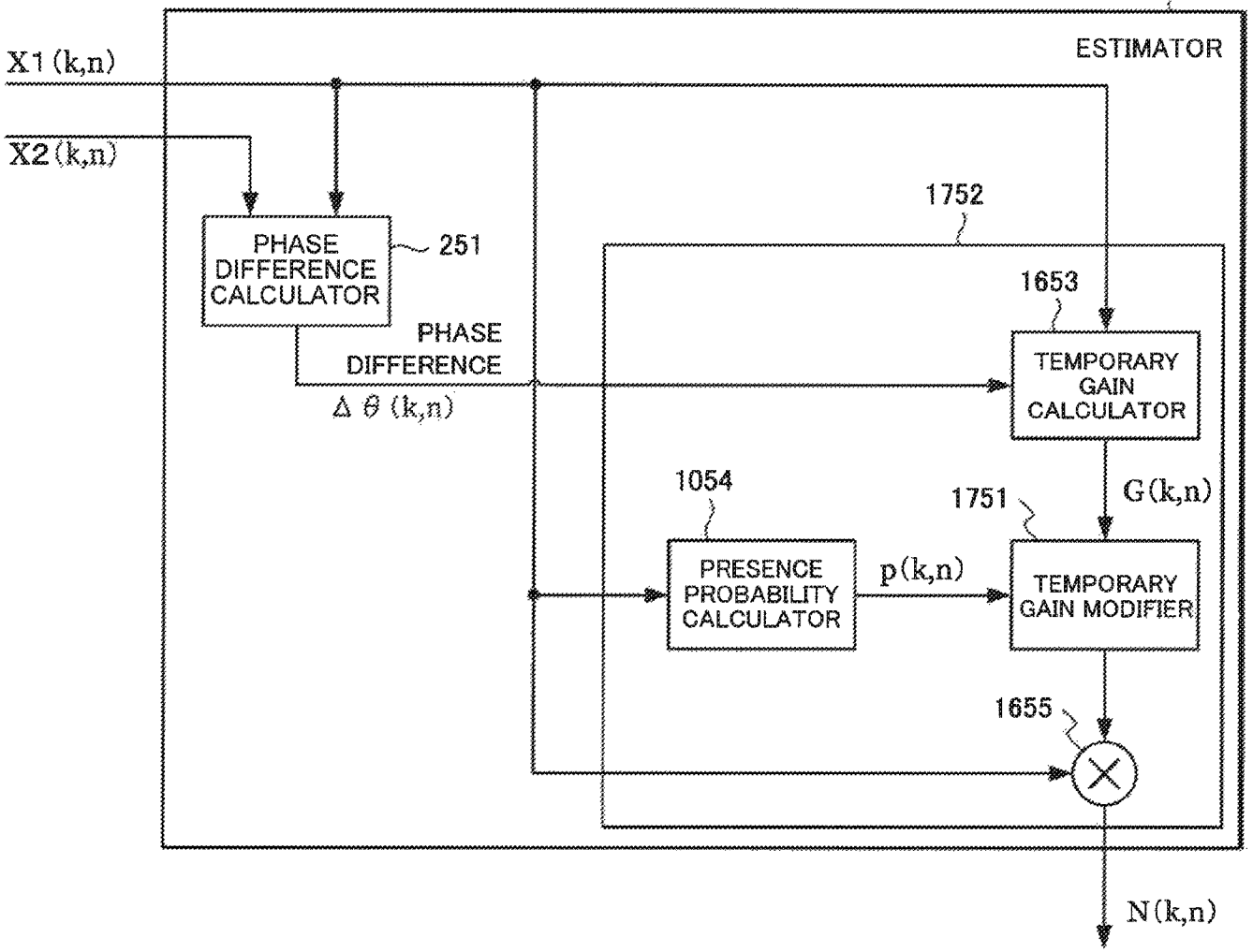
FIG. 17 is a block diagram showing an arrangement of the estimator in the signal processing apparatus according to the twelfth embodiment of the present invention.

A signal processing apparatus according to the twelfth embodiment of the present invention will be described with reference to FIG. 17. FIG. 17 is a block diagram showing an arrangement of the estimator 1705 of the signal processing apparatus according to this embodiment. The estimator 1705 according to this embodiment is different from the estimator 1605 according to the eleventh embodiment in that the estimator 1705 includes an estimated interfering sound generator 1752 having the presence probability calculator 1054 and a temporary gain modifier 1751. The rest of the components and operations are the same as in the eleventh embodiment. Hence, the same reference numbers are used to denote the same components and operations, and a detailed description thereof will be omitted.

The temporary gain modifier 1751 obtains a gain by modifying the temporary gain supplied from the temporary gain calculator 1653 using the presence probability p(k, n) supplied from the presence probability calculator 1054. Basically, when the presence probability of the first signal component is high, a value of the temporary gain is set to a small value. When the presence probability of the first signal component is represented by p(k, n), the modified gain G bar(k, n) is given as follows.

$$G\mathrm{bar}(k,n)=F(1-p(k,n))(G(k,n), \qquad \text{[Equation 26]}$$

where F(x) is a monotonously increasing function of x and F(x)>0 is satisfied. As p(k, n) is closer to 1, F(1−p(k, n)) becomes smaller.

According to this embodiment, the temporary gain is modified using the presence probability of the first signal component. Therefore, according to this embodiment, it is possible to modify the phase difference more accurately, compared to the eleventh embodiment in which the presence probability of the first signal component is not used, and thereby improving the accuracy of estimating the second signal component and the quality of the enhanced signal.

Note that like in the sixth embodiment, the presence probability calculator 1054 may calculate the presence probability using two or more mixed signal spectra.

Thirteenth Embodiment

Figure 18:
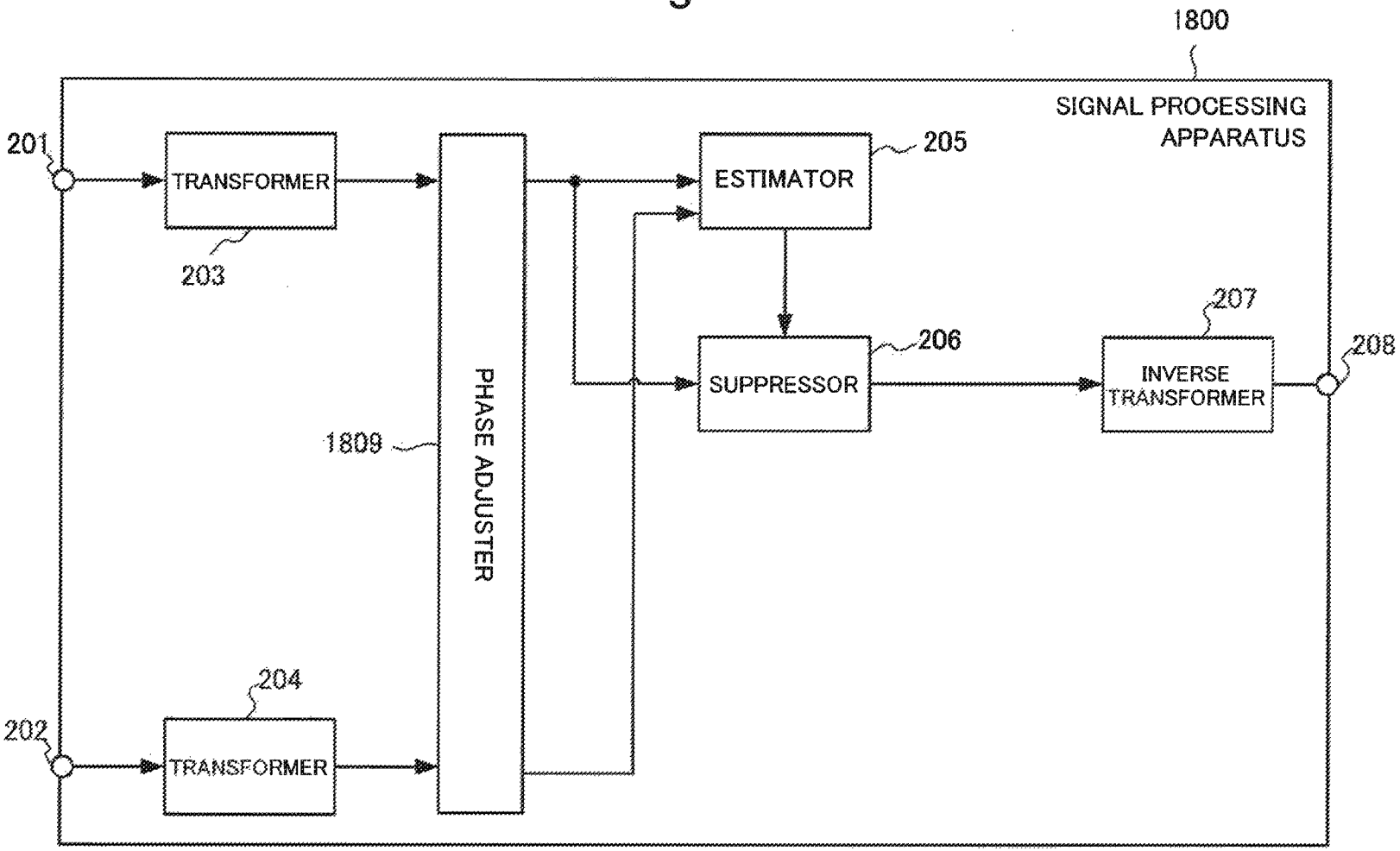
FIG. 18 is a block diagram showing an arrangement of the signal processing apparatus according to the thirteenth embodiment of the present invention.

A signal processing apparatus according to the thirteenth embodiment of the present invention will be described with reference to FIG. 18. FIG. 18 is a block diagram showing an arrangement of a signal processing apparatus 1800 according to this embodiment. The signal processing apparatus 1800 according to this embodiment is different from the signal processing apparatus 200 according to the second embodiment in that the signal processing apparatus 1800 includes a phase adjuster 1809. The rest of the components and operations are the same as in the second embodiment. Hence, the same reference numbers are used to denote the same components and operations, and a detailed description thereof will be omitted.

The phase adjuster 1809 receives the mixed signal spectra supplied from the transformers 203 and 204, and adjusts the phases of the signals from respective transformers in such a way that the first signal component looks as if it equivalently arrived from straight ahead. This is processing called beam steering. The beam steering is disclosed in detail in NPL 12 and NPL 13, and thus the description thereof will be omitted.

According to this embodiment, the beam steering is implemented by adjusting the phase difference between mixed signal spectra. Therefore, according to this embodiment, it is possible to obtain, even if the target sound does not arrive from straight ahead, the accuracy in estimating the second signal component equivalent to that when the target sound arrives from straight ahead.

Fourteenth Embodiment

Figure 19:
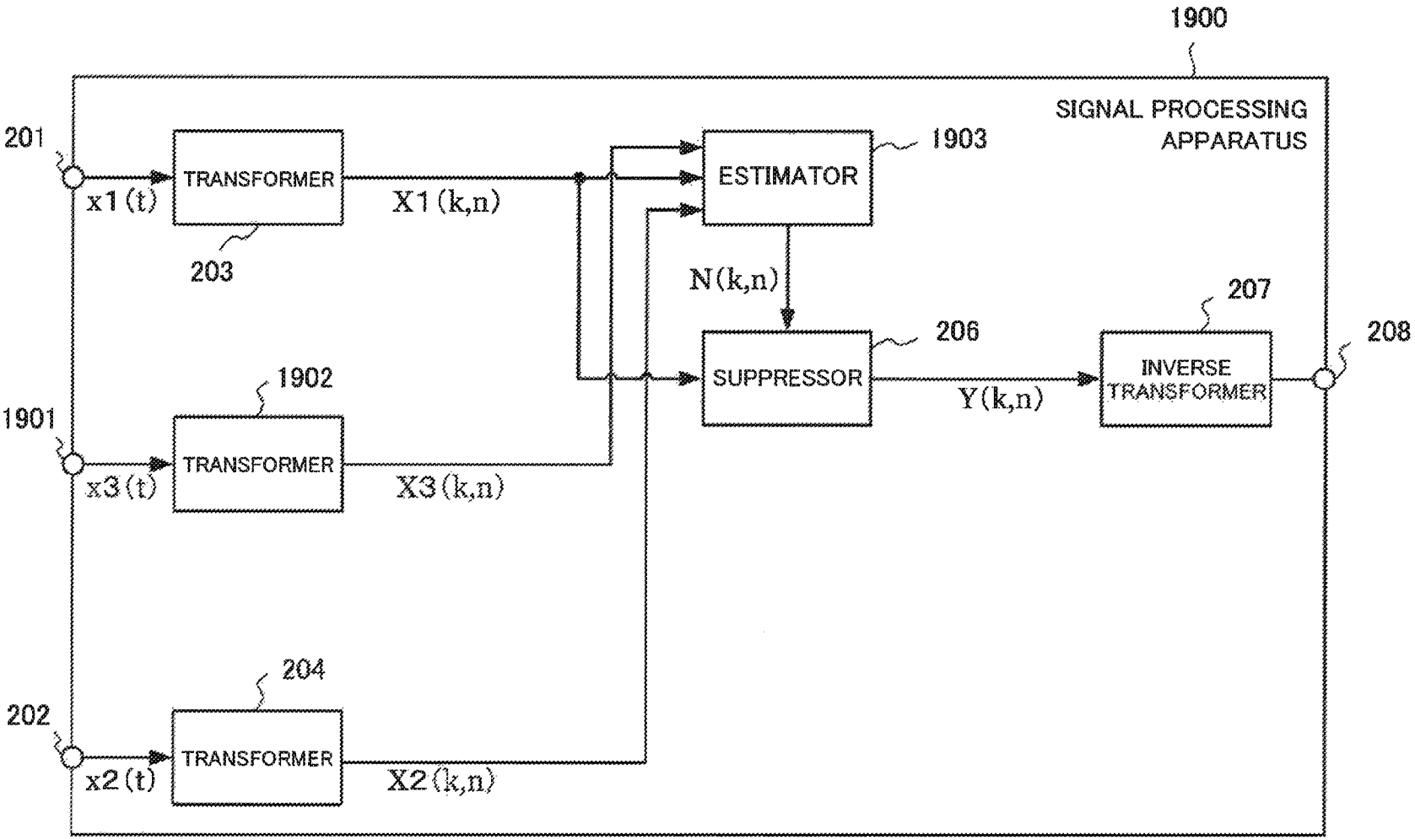
FIG. 19 is a block diagram showing an arrangement of the signal processing apparatus in the fourteenth embodiment of the present invention.

A signal processing apparatus according to the fourteenth embodiment of the present invention will be described with reference to FIG. 19. FIG. 19 is a block diagram showing an arrangement of a signal processing apparatus 1900 according to this embodiment. The signal processing apparatus 1900 according to this embodiment is different from the signal processing apparatus 200 according to the second embodiment in that the signal processing apparatus 1900 includes a sensor 1901, a transformer 1902, and an estimator 1903. The rest of the components and operations are the same as in the second embodiment. Hence, the same reference numbers are used to denote the same components and operations, and a detailed description thereof will be omitted.

The mixed signal is supplied to the sensor 1901 as a series of sample values X3($t$). The transformer 1902 converts the mixed signal supplied to the sensor 1901 into a plurality of frequency components by applying a transform, such as Fourier transform.

The estimator 1903 estimates the second signal component included in the mixed signal spectrum X1($k$, $n$) using the mixed signal spectra X1($k$, $n$), X2($k$, $n$), and X3($k$, $n$) supplied from the transformers 203, 204, and 1901 to generate an estimated second signal component N(k, n). Details of the estimator 1903 will be described with reference to FIG. 20.

Figure 20:
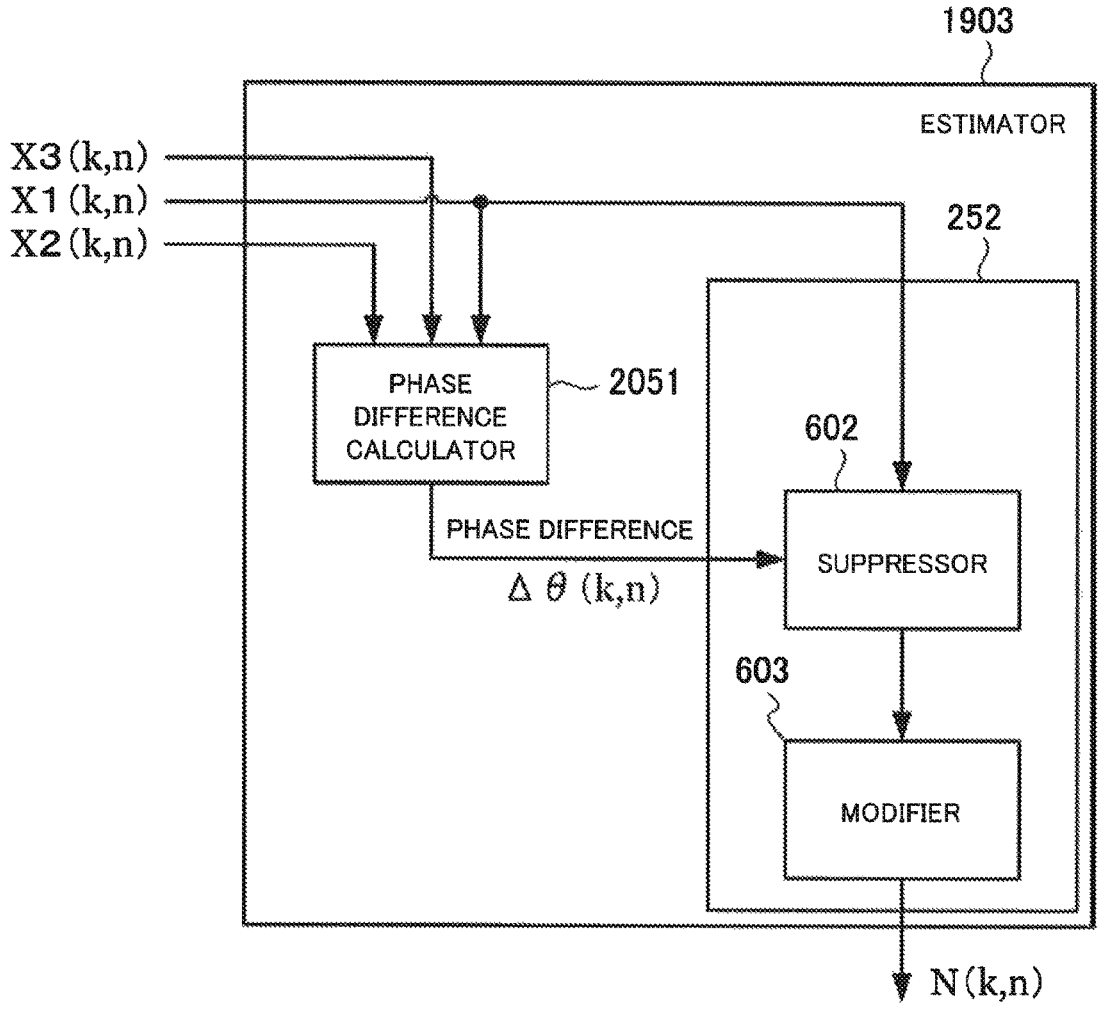
FIG. 20 is a block diagram showing an arrangement of the estimator in the signal processing apparatus according to the fourteenth embodiment of the present invention.

FIG. 20 is a block diagram showing an arrangement of the estimator 1903 of the signal processing apparatus 1900 according to this embodiment. The estimator 1903 according to this embodiment is different from the estimator 205 according to the second embodiment in that the estimator 1903 includes a phase difference calculator 2051. The rest of the components and operations are the same as in the second embodiment. Hence, the same reference numbers are used to denote the same components and operations, and a detailed description thereof will be omitted.

The phase difference calculator 2051 calculates a phase difference among mixed signal spectra using the mixed signal spectra X1($k$, $n$), X2($k$, $n$), and X3($k$, $n$) supplied from the transformers 203, 204, and 1901. First, phase differences are respectively calculated for all pairs among the three mixed signal spectra. Specifically, the phase differences are calculated for all of a pair of X1($k$, $n$) and X2($k$, $n$), a pair of X2($k$, $n$) and X3($k$, $n$), and a pair of X3($k$, $n$) and X1($k$, $n$). The phase differences of the respective pairs are represented by $\Delta\theta$12($k$, $n$), $\Delta\theta$23($k$, $n$), and $\Delta\theta$31($k$, $n$).

The phase differences of the respective pairs are obtained by the method described in the second embodiment. Then, the phase differences of all pairs are integrated into one phase difference.

The phase differences are integrated based on a statistic value calculated from the phase differences of the respective pairs, i.e., $\Delta\theta$12($k$, $n$), $\Delta\theta$23($k$, $n$), and $\Delta\theta$31($k$, $n$). In other words, the statistic value calculated from the three phase differences is used as the final phase difference. Examples of the statistic value may be an average value, a median, a maximum value, and a minimum value. Selecting the average value or median reduces variance of the phase differences, and thereby improving the accuracy of the phase difference. Selecting the minimum value has an effect that the characteristics of a region where the phase difference is small also applies to a region where the phase difference is large. This leads to an effect of equivalently extending the stopband, and thereby producing a powerful effect in a case where a large gain value is likely to be given erroneously to the target signal due to an error in calculation of the phase difference.

According to this embodiment, the phase difference is calculated based on three mixed signals. The phase difference is obtained by integrating three phase differences calculated individually from the three mixed signals. Accordingly, it is possible to obtain the phase difference more accurately compared to the second embodiment in which one phase difference is obtained from two mixed signals. Therefore, according to this embodiment, the accuracy of estimating the second signal component and the quality of the enhanced signal are improved.

In this embodiment, the case of using three mixed signals has been described. However, the phase difference is obtained more accurately by further increasing the number of mixed signals. The number of mixed signals may be increased not only in the second embodiment, but also in other embodiments. In other embodiments, by also using three or more mixed signals, the phase difference is obtained accurately, so that the accuracy of estimating the second signal component and the quality of the enhanced signal are improved.

Fifteenth Embodiment

Figure 21:
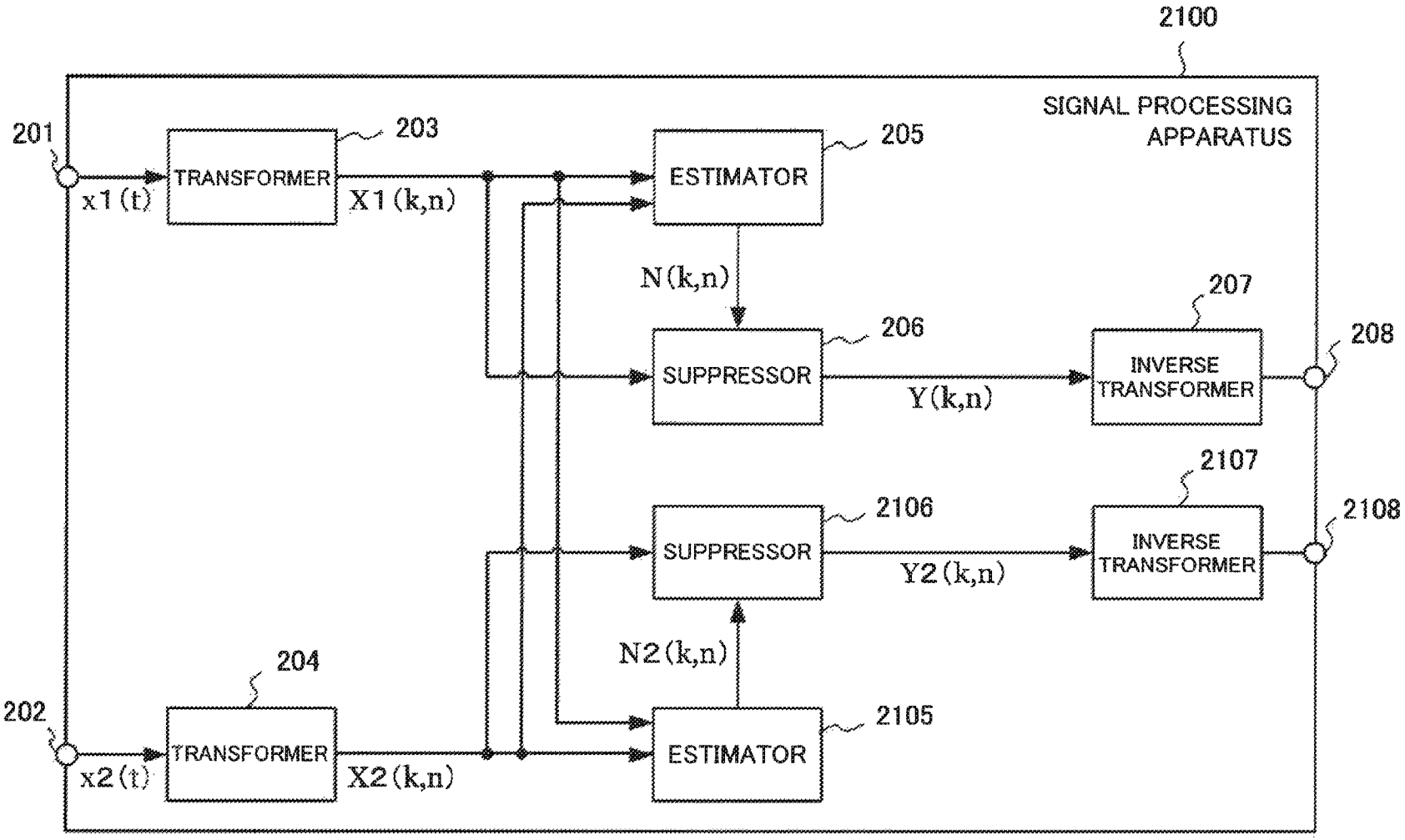
FIG. 21 is a block diagram showing an arrangement of the signal processing apparatus according to the fifteenth embodiment of the present invention.

A signal processing apparatus according to the fifteenth embodiment of the present invention will be described with reference to FIG. 21. FIG. 21 is a block diagram showing an arrangement of a signal processing apparatus 2100 according to this embodiment. The signal processing apparatus 2100 according to this embodiment is different from the signal processing apparatus 200 according to the second embodiment in that the signal processing apparatus 2100 includes, for each of the transformers, a set of an estimator, a suppressor, and an inverse transformer. The rest of the components and operations are the same as in the second embodiment. Hence, the same reference numbers are used to denote the same components and operations, and a detailed description thereof will be omitted.

An estimator 2105 estimates the second signal component included in the mixed signal spectrum X2(*k, n*) supplied from the transformer 204 to generate an estimated second signal component N2 (*k, n*).

The suppressor 2106 suppresses the second signal component included in the mixed signal spectrum X2(*k, n*) supplied from the transformer 204 using the estimated second signal component N2 (*k, n*), and transmits an enhanced signal spectrum Y2(*k, n*), which is a result of suppression, to an inverse transformer 2107.

The inverse transformer 2107 applies inverse transform on the enhanced signal spectrum Y2(*k, n*) supplied from the suppressor 2106, and supplies the enhanced signal to an output terminal 2108.

The estimator 2105 estimates the second signal component included in the mixed signal spectrum X2(*k, n*) by the same method as that used in the estimator 205. The suppressor 2106 suppresses the second signal component included in the mixed signal spectrum X2(*k, n*) by the same method as that used in the suppressor 206. The inverse transformer 2107 calculates the inverse transform of the enhanced signal spectrum Y2 (*k, n*) by the same method as that used in the inverse transformer 207.

According to this embodiment, two enhanced signals are generated. Therefore, according to this embodiment, the quality is improved as compared with the second embodiment in which only one enhanced signal is generated. In particular, this embodiment is effective when a stereo signal is processed, and stereophonic perception (realistic sensation) is improved as compared with the case where one signal is output.

Sixteenth Embodiment

Figure 22:
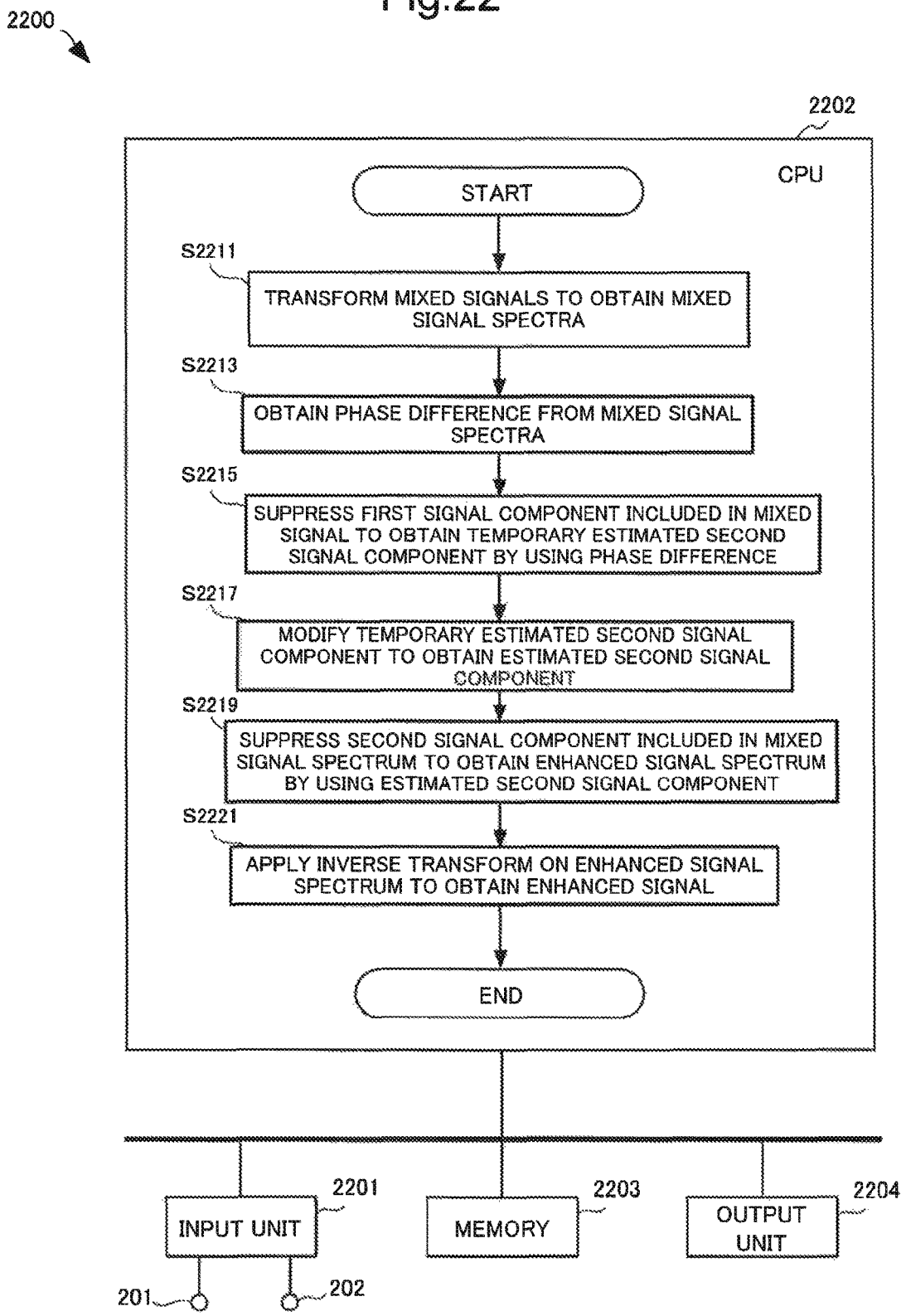
FIG. 22 is a block diagram showing the signal processing apparatus according to the sixteenth embodiment of the present invention.

A signal processing apparatus according to the sixteenth embodiment of the present invention will be described with reference to FIG. 22. FIG. 22 is a block diagram showing a hardware arrangement of a signal processing apparatus 2200 according to this embodiment.

The signal processing apparatus 2200 includes an input unit 2201, a CPU (Central Processing Unit) 2202, a memory 2203, and an output unit 2204.

The input unit 2201 includes interfaces connected to the sensors 201 and 202.

The CPU 2202 receives output signals of the sensors 201 and 202 from the input unit 2201, and executes signal processing.

The memory 2203 temporarily stores the signals input from the sensors 201 and 202, for the respective sensors 201 and 202. The memory 2203 further includes an area for executing a signal processing program.

A flow of processing executed by the CPU 2202 in the signal processing apparatus 2200 will be exemplarily described below, for the case where the signal processing described in the second embodiment is implemented by software.

First, in step S2211, two mixed signals in which the first signal component and the second signal component are mixed are input from the sensors 201 and 202, and these mixed signals are transformed to two mixed signal spectra. In step S2213, a phase difference between one of the mixed signal spectra and the other one of the mixed signal spectra is obtained. In step S2215, a temporary estimated second signal component is generated by suppressing the first signal component included in one of the mixed signal spectra using the phase difference. In step S2217, an estimated second signal component N(k, n) is generated by modifying the temporary estimated second signal component. In step S2219, an enhanced signal spectrum is generated by suppressing the second signal component included in one of the mixed signal spectra using the estimated second signal component N(k, n). In step S2221, an enhanced signal is generated by applying an inverse transform on the enhanced signal spectrum.

Program modules for these processes are stored in the memory 2203, and these program modules stored in the memory 2203 are sequentially executed by the CPU 2202, thereby obtaining the effects similar to those of the second embodiment.

With respect to the third to fifteenth embodiments, the effects similar to those of the aforementioned embodiments are also obtained by storing program modules corresponding to the functions and components shown in the block diagrams in the memory 2203, and executing these program modules by the CPU 2202.

Other Embodiments

In the first to sixteenth embodiments, the signal processing apparatuses having different features have been described. A signal processing apparatus obtained by arbitrarily combining these features is also encompassed in the scope of the present invention. Further, the present invention may be applied to a system including a plurality of devices, or may be applied to a single apparatus. Furthermore, the present invention can also be applied to a case where a processing program of software for implementing the functions of an embodiment is supplied to a system or an apparatus directly or remotely. Therefore, a program to be installed in a computer in order to implement the functions of the present invention on the computer, or a medium storing the program, and a WWW server for downloading the program are also encompassed in the scope of the present invention.

Other Expressions of Embodiments

The whole or part of the embodiments described above can be described as, but not limited to, the following supplementary notes.

(Supplementary Note 1)

A signal processing apparatus including:

phase difference calculating means for calculating a phase difference between a first input signal and a second input signal, the first input signal being generated based on a first input sound which is input in an environment where a target sound and an interfering sound are mixed, and the second input signal being generated based on a second input sound which is input in the environment; and generating means for generating an estimated interfering sound signal, based on the phase difference and the first input signal.

(Supplementary Note 2)

The signal processing apparatus according to supplementary note 1, further including first suppression means for generating an enhanced signal in which a component of the interfering sound included in the first input signal is suppressed based on the estimated interfering sound signal.

(Supplementary Note 3)

The signal processing apparatus according to supplementary note 1 or 2, wherein the generating means includes:

target sound suppression means for generating a temporary estimated interfering sound signal by suppressing a component of the target sound included in the first input signal using the phase difference; and modification means for generating the estimated interfering sound signal by modifying the temporary estimated interfering sound signal.

(Supplementary Note 4)

The signal processing apparatus according to supplementary note 3, wherein the modification means generates the estimated interfering sound signal by modifying the temporary estimated interfering sound signal, based on the first input signal.

(Supplementary Note 5)

The signal processing apparatus according to supplementary note 4, wherein the modification means generates the estimated interfering sound signal by modifying the temporary estimated interfering sound signal, based on the first input signal and the second input signal.

(Supplementary Note 6)

The signal processing apparatus according to supplementary note 3, wherein the generating means further includes presence probability calculation means for calculating a presence probability of the component of the target sound included in the first input signal, and the modification means generates the estimated interfering sound signal by modifying the temporary estimated interfering sound signal, based on the presence probability of the component of the target sound.

(Supplementary Note 7)

The signal processing apparatus according to any one of supplementary notes 3 to 6, wherein the modification means generates the estimated interfering sound signal by mixing a smoothed interfering sound signal obtained by smoothing the temporary estimated interfering sound signal along a time direction or a frequency direction and the temporary estimated interfering sound signal before smoothing.

(Supplementary Note 8)

The signal processing apparatus according to supplementary note 6, wherein the presence probability calculation means calculates the presence probability of the component of the target sound included in the first input signal, based on the first input signal and the second input signal.

(Supplementary Note 9)

The signal processing apparatus according to any one of supplementary note 6, 7, and 8, wherein the modification means generates the estimated interfering sound signal by modifying the temporary estimated interfering sound signal, based on the first input signal and the presence probability.

(Supplementary Note 10)

The signal processing apparatus according to any one of supplementary note 6, 7, and 8, wherein the modification means generates the estimated interfering sound signal by modifying the temporary estimated interfering sound signal, based on the first input signal, the second input signal, and the presence probability.

(Supplementary Note 11)

The signal processing apparatus according to any one of supplementary notes 1 to 10, wherein the phase difference calculating means further includes:

temporary phase difference calculation means for calculating a temporary phase difference between a phase of the first input signal and a phase of the second input signal; and temporary phase difference modification means for generating the phase difference by modifying the temporary phase difference.

(Supplementary Note 12)

The signal processing apparatus according to supplementary note 11, wherein the temporary phase difference modification means generates the phase difference by modifying the temporary phase difference, based on a presence probability of a component of the target sound included in the first input signal.

(Supplementary Note 13)

The signal processing apparatus according to any one of supplementary notes 1 to 12, wherein the generating means includes:

temporary gain calculation means for calculating a temporary gain, based on the first input signal and the phase difference;

temporary gain modification means for generating a gain by modifying the temporary gain; and multiplication means for generating the estimated interfering sound signal by multiplying the first input signal by the gain.

(Supplementary Note 14)

The signal processing apparatus according to supplementary note 13, wherein the temporary gain modification means generates the gain by modifying the temporary gain based on a presence probability of a component of the target sound included in the first input signal.

(Supplementary Note 15)

The signal processing apparatus according to any one of supplementary notes 1 to 14, further including phase adjustment means for generating a first phase adjusted signal and a second phase adjusted signal by adjusting a phase of the first input signal and a phase of the second input signal, respectively, wherein the first phase adjusted signal and the second phase adjusted signal are used instead of the first input signal and the second input signal, respectively.

(Supplementary Note 16)

The signal processing apparatus according to any one of supplementary notes 1 to 15, wherein the phase difference calculating means calculates a phase difference among the first input signal, the second input signal, and a third input signal, the first input signal being generated based on the first input sound which is input in the environment where the target sound and the interfering sound are mixed, the second input signal being generated based on the second input sound which is input in the environment, and the third input signal being generated based on the third input sound which is input in the environment.

(Supplementary Note 17)

The signal processing apparatus according to any one of supplementary notes 1 to 16, further including second suppression means for suppressing a component of the interfering sound included in the second input signal based on the estimated interfering sound signal.

(Supplementary Note 18)

A signal processing method including:

a step for calculating a phase difference between a first input signal and a second input signal, the first input signal being generated based on a first input sound which is input in an environment where a target sound and an interfering sound are mixed, and the second input signal being generated based on a second input sound which is input in the environment; and a step for generating an estimated interfering sound signal, based on the phase difference and the first input signal.

(Supplementary Note 19)

A signal processing program causing a computer to execute:

a step for calculating a phase difference between a first input signal and a second input signal, the first input signal being generated based on a first input sound which is input in an environment where a target sound and an interfering sound are mixed, and the second input signal being generated based on a second input sound which is input in the environment; and a step for generating an estimated interfering sound signal, based on the phase difference and the first input signal.

This application is based upon and claims the benefit of priority from Japanese Patent Application No. 2015-131978, filed on Jun. 30, 2015, the disclosure of which is incorporated herein in its entirety by reference.

The invention claimed is:

1. A signal processing apparatus comprising:

a phase difference calculator that calculates a phase difference between a first input signal and a second input signal, the first input signal being generated based on a first input sound which is input in an environment where a target sound and an interfering sound are mixed, and the second input signal being generated based on a second input sound which is input in the same environment; and a generator that generates an estimated interfering sound signal, based on the phase difference and the first input signal, wherein the generator includes:

a target sound suppressor that generates a temporary estimated interfering sound signal by suppressing a component of the target sound included in the first input signal using the phase difference:

a presence probability calculator that calculates a presence probability of the component of the target sound included in the first input signal; and a modifier that generates the estimated interfering sound signal by modifying the temporary estimated interfering sound signal, based on the presence probability of the component of the target sound.

2. The signal processing apparatus according to claim 1, further comprising a first suppressor that generates an enhanced signal in which a component of the interfering sound included in the first input signal is suppressed based on the estimated interfering sound signal.

3. The signal processing apparatus according to claim 1, wherein the modifier generates the estimated interfering sound signal by modifying the temporary estimated interfering sound signal, based on the first input signal.

4. The signal processing apparatus according to claim 3, wherein the modifier generates the estimated interfering sound signal by modifying the temporary estimated interfering sound signal, based on the first input signal and the second input signal.

5. The signal processing apparatus according to claim 1, wherein the modifier generates the estimated interfering sound signal by mixing a smoothed interfering sound signal obtained by smoothing the temporary estimated interfering sound signal along time or frequency and the temporary estimated interfering sound signal before smoothing.

6. The signal processing apparatus according to claim 1, wherein the presence probability calculator calculates the presence probability of the component of the target sound included in the first input signal, based on the first input signal and the second input signal.

7. The signal processing apparatus according to claim 1, wherein the modifier generates the estimated interfering sound signal by modifying the temporary estimated interfering sound signal, based on the first input signal and the presence probability.

8. The signal processing apparatus according to claim 1, wherein the modifier generates the estimated interfering sound signal by modifying the temporary estimated interfering sound signal, based on the first input signal, the second input signal, and the presence probability.

9. The signal processing apparatus according to claim 1, wherein the phase difference calculator further includes:

a temporary phase difference calculator that calculates a temporary phase difference between a phase of the first input signal and a phase of the second input signal; and a temporary phase difference modifier that generates the phase difference by modifying the temporary phase difference.

10. The signal processing apparatus according to claim 9, wherein the temporary phase difference modifier generates the phase difference by modifying the temporary phase difference, based on the presence probability of the component of the target sound included in the first input signal.

11. The signal processing apparatus according to claim 1, wherein the generator includes:

a temporary gain calculator that calculates a temporary gain, based on the first input signal and the phase difference;

a temporary gain modifier that generates a gain by modifying the temporary gain; and a multiplier that generates the estimated interfering sound signal by multiplying the first input signal by the gain.

12. The signal processing apparatus according to claim 11, wherein the temporary gain modifier generates the gain by modifying the temporary gain based on e the presence probability of the component of the target sound included in the first input signal.

13. The signal processing apparatus according to claim 1, further comprising a phase adjuster that generates a first phase adjusted signal and a second phase adjusted signal by adjusting a phase of the first input signal and a phase of the second input signal, respectively, wherein the first phase adjusted signal and the second phase adjusted signal are used instead of the first input signal and the second input signal, respectively.

14. The signal processing apparatus according to claim 1, wherein the phase difference calculator calculates a phase difference among the first input signal, the second input signal, and a third input signal, the first input signal being generated based on the first input sound which is input in the environment where the target sound and the interfering sound are mixed, the second input signal being generated based on the second input sound which is input in the environment, and the third input signal being generated based on a third input sound which is input in the environment.

15. The signal processing apparatus according to claim 2, further comprising a second suppressor that suppresses a component of the interfering sound included in the second input signal based on the estimated interfering sound signal.

16. A signal processing method comprising:

calculating a phase difference between a first input signal and a second input signal, the first input signal being generated based on a first input sound which is input in an environment where a target sound and an interfering sound are mixed, and the second input signal being generated based on a second input sound which is input in the same environment; and generating an estimated interfering sound signal, based on the phase difference and the first input signal, wherein the generating the estimated interfering sound signal includes:

generating a temporary estimated interfering sound signal by suppressing a component of the target sound included in the first input signal using the phase difference:

calculating a presence probability of the component of the target sound included in the first input signal; and generating the estimated interfering sound signal by modifying the temporary estimated interfering sound signal, based on the presence probability of the component of the target sound.

17. A non-transitory computer readable storage medium recording thereon a signal processing program causing a computer to execute a method comprising:

calculating a phase difference between a first input signal and a second input signal, the first input signal being generated based on a first input sound which is input in an environment where a target sound and an interfering sound are mixed, and the second input signal being generated based on a second input sound which is input in the same environment; and generating an estimated interfering sound signal, based on the phase difference and the first input signal, wherein the generating the estimated interfering sound signal includes:

generating a temporary estimated interfering sound signal by suppressing a component of the target sound included in the first input signal using the phase difference;

calculating a presence probability of the component of the target sound included in the first input signal; and generating the estimated interfering sound signal by modifying the temporary estimated interfering sound signal, based on the presence probability of the component of the target sound.

* * * * *